US007926299B2

(12) United States Patent
Seki

(10) Patent No.: US 7,926,299 B2
(45) Date of Patent: Apr. 19, 2011

(54) AIR-CONDITIONER, METHOD OF CONTROLLING AIR DIRECTION OF AIR-CONDITIONER, AND METHOD OF CONTROLLING ACTUATOR

(75) Inventor: Tatsuo Seki, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 447 days.

(21) Appl. No.: 12/182,689

(22) Filed: Jul. 30, 2008

(65) Prior Publication Data

US 2009/0090125 A1 Apr. 9, 2009

(30) Foreign Application Priority Data

Oct. 5, 2007 (JP) ..... 2007-261646

(51) Int. Cl.
*F25D 17/04* (2006.01)
*F24F 7/00* (2006.01)
*G05D 7/00* (2006.01)

(52) U.S. Cl. ..... 62/407; 454/358; 454/258; 700/282

(58) Field of Classification Search ..... 62/407; 454/358, 258; 700/282
See application file for complete search history.

(56) References Cited

U.S. PATENT DOCUMENTS 5,331,825 A 7/1994 Kim

FOREIGN PATENT DOCUMENTS

| | | | |
|---|---|---|---|
| JP | 63143449 | A | 6/1988 |
| JP | 03263540 | A | 11/1991 |
| JP | 07-103551 | | 4/1995 |
| JP | 07103551 | A | 4/1995 |
| JP | 2001153433 | A | 6/2001 |
| JP | 2006-183974 | | 7/2006 |
| JP | 2006-220405 | | 8/2006 |
| JP | 2007-147120 | | 6/2007 |
| JP | 2007-147120 | A | 6/2007 |

OTHER PUBLICATIONS

Japanese Office Action, with Partial English-Language Translation, dated Oct. 27, 2009.
Final Office Action issued in the corresponding Japanese Patent Application No. 2007-261646 date Mar. 30, 2010, and an English Translation thereof.
European Search Report in corresponding application No. 08013777.1-2301 dated Jan. 5, 2009.

*Primary Examiner* — Chen-Wen Jiang
(74) *Attorney, Agent, or Firm* — Buchanan Ingersoll & Rooney PC

(57) ABSTRACT

A control device 15 includes: a target area deciding unit 21 for setting either of binary values of 0 and 1 to plural area sections and deciding a targeted area section for air-conditioning; and an area air direction control unit 22 for carrying out control operation, so that when controlling at least one of air direction control stepping motors directed to the targeted area section for air-conditioning, a left/right air direction control stepping motor carries out control operation based on depth direction one-dimensional data obtained by calculating a logical sun of each column in depth direction of each area section in a group of area sections, and an up/down air direction control stepping motor carries out control operation based on left/right direction one-dimensional data obtained by calculating a logical sum of each column in left/right direction of each area section in the group of area sections.

4 Claims, 23 Drawing Sheets

Fig. 11

| NO. | A COLUMN (LEFT COLUMN) | B COLUMN (LEFT CENTER COLUMN) | C COLUMN (CENTER COLUMN) | D COLUMN (RIGHT CENTER COLUMN) | E COLUMN (RIGHT COLUMN) | SETTING ANGLE FOR LEFT/RIGHT AIR DIRECTION CONTROL BOARD (LEFT) | SETTING ANGLE FOR LEFT/RIGHT AIR DIRECTION CONTROL BOARD (RIGHT) |
|---|---|---|---|---|---|---|---|
| 1 | 0 | 0 | 0 | 0 | 0 | DIRECTED TO LEFT CENTER | DIRECTED TO RIGHT CENTER |
| 2 | 0 | 0 | 0 | 0 | 1 | DIRECTED TO RIGHT | DIRECTED TO RIGHT |
| 3 | 0 | 0 | 0 | 1 | 0 | DIRECTED TO RIGHT CENTER | DIRECTED TO RIGHT CENTER |
| 4 | 0 | 0 | 0 | 1 | 1 | DIRECTED TO RIGHT CENTER | DIRECTED TO RIGHT |
| 5 | 0 | 0 | 1 | 0 | 0 | DIRECTED TO CENTER | DIRECTED TO CENTER |
| 6 | 0 | 0 | 1 | 0 | 1 | DIRECTED TO CENTER | DIRECTED TO RIGHT |
| 7 | 0 | 0 | 1 | 1 | 0 | DIRECTED TO CENTER | DIRECTED TO RIGHT CENTER |
| 8 | 0 | 0 | 1 | 1 | 1 | DIRECTED TO CENTER | DIRECTED TO RIGHT CENTER |
| 9 | 0 | 1 | 0 | 0 | 0 | DIRECTED TO LEFT CENTER | DIRECTED TO LEFT CENTER |
| 10 | 0 | 1 | 0 | 0 | 1 | DIRECTED TO LEFT CENTER | DIRECTED TO RIGHT |
| 11 | 0 | 1 | 0 | 1 | 0 | DIRECTED TO LEFT CENTER | DIRECTED TO RIGHT CENTER |
| 12 | 0 | 1 | 0 | 1 | 1 | DIRECTED TO LEFT CENTER | DIRECTED TO RIGHT CENTER |
| 13 | 0 | 1 | 1 | 0 | 0 | DIRECTED TO LEFT CENTER | DIRECTED TO CENTER |
| 14 | 0 | 1 | 1 | 0 | 1 | DIRECTED TO LEFT CENTER | DIRECTED TO RIGHT |
| 15 | 0 | 1 | 1 | 1 | 0 | DIRECTED TO LEFT CENTER | DIRECTED TO RIGHT CENTER |
| 16 | 0 | 1 | 1 | 1 | 1 | DIRECTED TO LEFT CENTER | DIRECTED TO RIGHT CENTER |
| 17 | 1 | 0 | 0 | 0 | 0 | DIRECTED TO LEFT | DIRECTED TO LEFT |
| 18 | 1 | 0 | 0 | 0 | 0 | DIRECTED TO LEFT | DIRECTED TO RIGHT |
| 19 | 1 | 0 | 0 | 1 | 0 | DIRECTED TO LEFT | DIRECTED TO RIGHT CENTER |
| 20 | 1 | 0 | 0 | 1 | 1 | DIRECTED TO LEFT | DIRECTED TO RIGHT CENTER |
| 21 | 1 | 0 | 1 | 0 | 0 | DIRECTED TO LEFT | DIRECTED TO CENTER |
| 22 | 1 | 0 | 1 | 0 | 1 | DIRECTED TO LEFT CENTER | DIRECTED TO RIGHT CENTER |
| 23 | 1 | 0 | 1 | 1 | 0 | DIRECTED TO LEFT | DIRECTED TO RIGHT CENTER |
| 24 | 1 | 0 | 1 | 1 | 1 | DIRECTED TO LEFT | DIRECTED TO RIGHT CENTER |
| 25 | 1 | 1 | 0 | 0 | 0 | DIRECTED TO LEFT | DIRECTED TO LEFT CENTER |
| 26 | 1 | 1 | 0 | 0 | 1 | DIRECTED TO LEFT CENTER | DIRECTED TO RIGHT |
| 27 | 1 | 1 | 0 | 1 | 0 | DIRECTED TO LEFT CENTER | DIRECTED TO RIGHT CENTER |
| 28 | 1 | 1 | 0 | 1 | 1 | DIRECTED TO LEFT CENTER | DIRECTED TO RIGHT CENTER |
| 29 | 1 | 1 | 1 | 0 | 0 | DIRECTED TO LEFT | DIRECTED TO CENTER |
| 30 | 1 | 1 | 1 | 0 | 1 | DIRECTED TO LEFT CENTER | DIRECTED TO RIGHT |
| 31 | 1 | 1 | 1 | 1 | 0 | DIRECTED TO LEFT CENTER | DIRECTED TO RIGHT CENTER |
| 32 | 1 | 1 | 1 | 1 | 1 | DIRECTED TO LEFT CENTER | DIRECTED TO RIGHT CENTER |

Fig. 14

| NO. | LEFT REGION | CENTER REGION | RIGHT REGION | HANDLED BY UP/DOWN AIR DIRECTION CONTROL BOARD (LEFT) | HANDLED BY UP/DOWN AIR DIRECTION CONTROL BOARD (RIGHT) |
|---|---|---|---|---|---|
| 1 | 0 | 0 | 0 | LEFT + CENTER REGION | RIGHT + CENTER REGION |
| 2 | 0 | 1 | 1 | RIGHT REGION | RIGHT REGION |
| 3 | 0 | 1 | 0 | CENTER REGION | CENTER REGION |
| 4 | 0 | 0 | 1 | CENTER REGION | RIGHT REGION |
| 5 | 1 | 0 | 0 | LEFT REGION | LEFT REGION |
| 6 | 1 | 0 | 1 | LEFT REGION | RIGHT REGION |
| 7 | 1 | 1 | 0 | LEFT REGION | CENTER REGION |
| 8 | 1 | 1 | 1 | LEFT + CENTER REGION | RIGHT + CENTER REGION |

Fig. 15

| NO. | 1ST ROW (FRONT ROW) | 2ND ROW (MIDDLE ROW) | 3RD ROW (BACK ROW) | SETTING ANGLE FOR UP/DOWN AIR DIRECTION CONTROL BOARD |
|---|---|---|---|---|
| 1 | 0 | 0 | 0 | UP/DOWN AIR DIRECTION NO. 3 |
| 2 | 0 | 0 | 1 | UP/DOWN AIR DIRECTION NO. 1 |
| 3 | 0 | 1 | 0 | UP/DOWN AIR DIRECTION NO. 3 |
| 4 | 0 | 1 | 1 | UP/DOWN AIR DIRECTION NO. 2 |
| 5 | 1 | 0 | 0 | UP/DOWN AIR DIRECTION NO. 5 |
| 6 | 1 | 0 | 1 | UP/DOWN AIR DIRECTION NO. 3 |
| 7 | 1 | 1 | 0 | UP/DOWN AIR DIRECTION NO. 4 |
| 8 | 1 | 1 | 1 | UP/DOWN AIR DIRECTION NO. 3 |

Fig. 32

| NO. | A COLUMN (LEFT COLUMN) | B COLUMN (LEFT CENTER COLUMN) | C COLUMN (CENTER COLUMN) | D COLUMN (RIGHT CENTER COLUMN) | E COLUMN (RIGHT COLUMN) | SETTING ANGLE FOR LEFT/RIGHT AIR DIRECTION CONTROL BOARD |
|---|---|---|---|---|---|---|
| 1 | 0 | 0 | 0 | 0 | 0 | DIRECTED TO CENTER |
| 2 | 0 | 0 | 0 | 0 | 1 | DIRECTED TO RIGHT |
| 3 | 0 | 0 | 0 | 1 | 0 | DIRECTED TO RIGHT CENTER |
| 4 | 0 | 0 | 0 | 1 | 1 | SWING BETWEEN RIGHT CENTER AND RIGHT DIRECTION |
| 5 | 0 | 0 | 1 | 0 | 0 | DIRECTED TO CENTER |
| 6 | 0 | 0 | 1 | 0 | 1 | SWING BETWEEN CENTER AND RIGHT DIRECTION |
| 7 | 0 | 0 | 1 | 1 | 0 | SWING BETWEEN CENTER AND RIGHT CENTER DIRECTION |
| 8 | 0 | 0 | 1 | 1 | 1 | SWING BETWEEN CENTER AND RIGHT DIRECTION |
| 9 | 0 | 1 | 0 | 0 | 0 | DDIRECTED TO LEFT CENTER |
| 10 | 0 | 1 | 0 | 0 | 1 | SWING BETWEEN LEFT CENTER AND RIGHT DIRECTION |
| 11 | 0 | 1 | 0 | 1 | 0 | SWING BETWEEN LEFT CENTER AND RIGHT CENTER DIRECTION |
| 12 | 0 | 1 | 0 | 1 | 1 | SWING BETWEEN LEFT CENTER AND RIGHT DIRECTION |
| 13 | 0 | 1 | 1 | 0 | 0 | SWING BETWEEN LEFT CENTER AND CENTER DIRECTION |
| 14 | 0 | 1 | 1 | 0 | 1 | SWING BETWEEN LEFT CENTER AND RIGHT DIRECTION |
| 15 | 0 | 1 | 1 | 1 | 0 | SWING BETWEEN LEFT CENTER AND RIGHT CENTER DIRECTION |
| 16 | 0 | 1 | 1 | 1 | 1 | SWING BETWEEN LEFT CENTER AND RIGHT DIRECTION |
| 17 | 1 | 0 | 0 | 0 | 0 | DIRECTED TO LEFT |
| 18 | 1 | 0 | 0 | 0 | 0 | SWING BETWEEN LEFT AND RIGHT DIRECTION |
| 19 | 1 | 0 | 0 | 1 | 0 | SWING BETWEEN LEFT AND RIGHT CENTER DIRECTION |
| 20 | 1 | 0 | 0 | 1 | 1 | SWING BETWEEN LEFT AND RIGHT DIRECTION |
| 21 | 1 | 0 | 1 | 0 | 0 | SWING BETWEEN LEFT AND CENTER DIRECTION |
| 22 | 1 | 0 | 1 | 0 | 1 | SWING BETWEEN LEFT AND RIGHT DIRECTION |
| 23 | 1 | 0 | 1 | 1 | 0 | SWING BETWEEN LEFT AND RIGHT CENTER DRECTION |
| 24 | 1 | 0 | 1 | 1 | 1 | SWING BETWEEN LEFT AND RIGHT DIRECTION |
| 25 | 1 | 1 | 0 | 0 | 0 | SWING BETWEEN LEFT AND LEFT CENTER DIRECTION |
| 26 | 1 | 1 | 0 | 0 | 1 | SWING BETWEEN LEFT AND RIGHT DRECTION |
| 27 | 1 | 1 | 0 | 1 | 0 | SWING BETWEEN LEFT AND RIGHT CENTER DIRECTION |
| 28 | 1 | 1 | 0 | 1 | 1 | SWING BETWEEN LEFT AND RIGHT DRECTION |
| 29 | 1 | 1 | 1 | 0 | 0 | SWING BETWEEN LEFT AND CENTER DIRECTION |
| 30 | 1 | 1 | 1 | 0 | 1 | SWING BETWEEN LEFT AND RIGHT DRECTION |
| 31 | 1 | 1 | 1 | 1 | 0 | SWING BETWEEN LEFT AND RIGHT CENTER DIRECTION |
| 32 | 1 | 1 | 1 | 1 | 1 | SWING BETWEEN LEFT AND RIGHT CDRECTION |

AIR-CONDITIONER, METHOD OF CONTROLLING AIR DIRECTION OF AIR-CONDITIONER, AND METHOD OF CONTROLLING ACTUATOR

BACKGROUND OF THE INVENTION

1. Field of the Invention

The present invention relates to an air-conditioner and a method of controlling air direction of the air-conditioner, in particular, to a method of controlling air direction, by which the air direction is controlled to direct to a specific area among plural divided areas of a room when the room is divided into the plural areas. Further, as its application, the present invention will refer to a method of controlling an actuator which is a mechanic element to convert to the final mechanical work in an equipment or a device.

2. Discussion of the Background

By a conventional air-conditioner, when a user directs blowing airflow of the air-conditioner to a desired position, it is necessary to set an up/down air direction angle and a left/right air direction angle with checking status of the airflow or assuming status of the airflow.

Further, by another conventional air-conditioner, in order to improve the above problem, an operation method has been disclosed to control air direction directed to a specific area among plural divided areas of indoor space which is a target for air-conditioning. However, the air direction control method in this case defines air direction directed to a specific area beforehand, and the air direction control is performed by referring to a table in which how to direct the air direction has been already decided (refer to Patent Document 1, for example).

LIST OF REFERENCES

[1] JP2007-147120 (pp. 5-7, FIGS. 10-19)

In the conventional air direction control method for an air-conditioner, a user has to set air direction with considering and directing to a place which the user desires to be air-conditioned, and thus there is a problem it is troublesome to set air direction with assuming a flow of blowing airflow.

Further, in order to improve this, some method does not set the air direction individually, but specifies an air-conditioning area such as a certain indoor area (Patent Document 1, for example), or the air-conditioner determines the air-conditioning area automatically, and sets the air-conditioning target area internally. However, in such a method for specifying an area which the user desires to be air-conditioned, though the operability is improved, when the air direction is controlled to the specified air-conditioning area, there is only a method in which the setting value of the air direction device is decided beforehand for each generation patterns of targeted areas.

In this method, as long as the number of area sections for air-conditioning is small, there are few problems; however, in order to control the blowing airflow of the air-conditioner more precisely, when the number of area sections is made large, there is a problem that generation patterns of targeted area increase exponentially. Concretely, if the number of area section is 4 areas, the number of generation patterns of targeted area sections is 16 patterns from calculation by combining two-term factor; similarly if the number of are sections is 6 areas, 64 patterns; if the number of area sections is 9 areas, 512 patterns; if the number of area sections is 15 areas, 32,768 patterns, as such the number of patterns increases extraordinarily as the number of area sections becomes large. When the number of area sections is, for example, 15 areas as discussed above, if it is tried to produce a table to decide which air direction corresponding to all generation patterns of targeted area sections, probability of human errors at setting time becomes very high, which causes a problem that quality of software may be degraded. Further, there is another problem that generation of such table as software oppresses variable capacity of microcomputer. Yet further, it requires vast amount of developing load/evaluation time period to develop a product because of the large-scale table.

Further, not only limited to the air direction control of the air-conditioner, but also when in an equipment or a device, its working space is divided into a large number of areas, and an actuator, which is a mechanic element to convert to the final mechanical work, is operated directing to a specific area section out of the divided areas, if the number of area sections of working space is large, there is the same problem as discussed above.

The present invention aims to solve the above problems and to provide an air-conditioner and an air direction controlling method for the air-conditioner, which removes the trouble of setting the air direction by the user and improves comfort by controlling the airflow with high precision, and does not waste valuable microcomputer capacity and maintains the quality of the software high and also improves development efficiency of the air-conditioner even if the number of area sections is large. Yet further, it aims to provide a controlling method for an actuator.

SUMMARY OF THE INVENTION

According to the present invention, an air-conditioner includes: an air-conditioner body; an up/down air direction control board provided at an air outlet blowing out air of the air-conditioner body for rectifying blowing airflow in up/down direction; an up/down air direction control stepping motor for adjusting an angle of the up/down air direction control board; a left/right air direction control board provided at the air outlet blowing out air of the air-conditioner body for rectifying blowing airflow in a left/right direction; a left/right air direction control stepping motor for adjusting an angle of the left/right air direction control board; a control device controlling at least the up/down air direction control stepping motor and the left/right air direction control stepping motor, and the control device includes: a target area deciding unit for setting either of binary values of 0 and 1 to each area section of a group of area sections which is obtained by developing two-dimensionally a plurality of area sections that are obtained by dividing an indoor space at which the air-conditioner is provided, and deciding a targeted area section for air-conditioning among the group of area sections; and an area air direction control unit for carrying out control operation, so that when controlling at least one of the up/down air direction control stepping motor and the left/right air direction control stepping motor directed to the targeted area section for air-conditioning, the left/right air direction control stepping motor carries out control operation based on depth direction one-dimensional data obtained by calculating a logical sum of each column in depth direction of each area section in the group of area sections, and the up/down air direction control stepping motor carries out control operation based on left/right direction one-dimensional data obtained by calculating a logical sum of each column in left/right direction of each area section in the group of area sections.

BRIEF DESCRIPTION OF THE DRAWINGS

A complete appreciation of the present invention and many of the attendant advantages thereof will be readily obtained as the same becomes better understood by reference to the following detailed description when considered in connection with the accompanying drawings, wherein:

FIG. 11 shows the first embodiment and shows a left/right air direction setting table to decide the operation of the left/right air direction control board of the air-conditioner;

FIG. 14 shows the first embodiment and shows an up/down air direction control boards (left)-(right) operation deciding table to decide the operation an up/down air direction control board (left) 6*a* and an up/down air direction control board (right) 6*b;*

FIG. 15 shows the first embodiment and shows an up/down air direction setting table to decide the operation of the up/down air direction control board of the air-conditioner;

FIG. 32 shows the third embodiment and shows a left/right air direction setting table to decide the left/right air direction control board;

DESCRIPTION OF THE PREFERRED EMBODIMENTS

Embodiment 1

Figure 1:
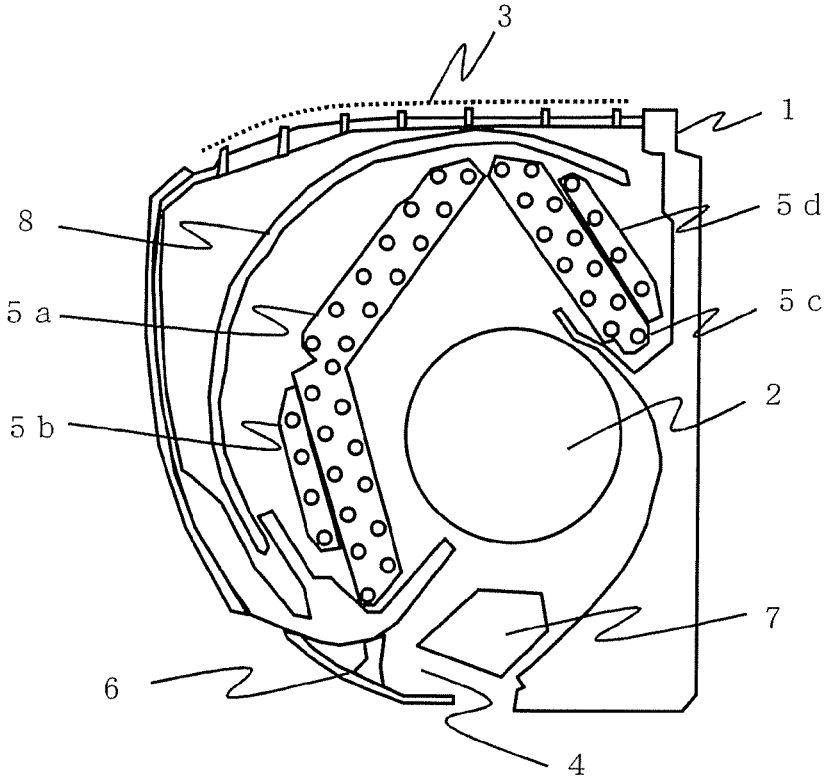
FIG. 1 shows the first embodiment and is a cross sectional view of an air-conditioner.
Figure 2:
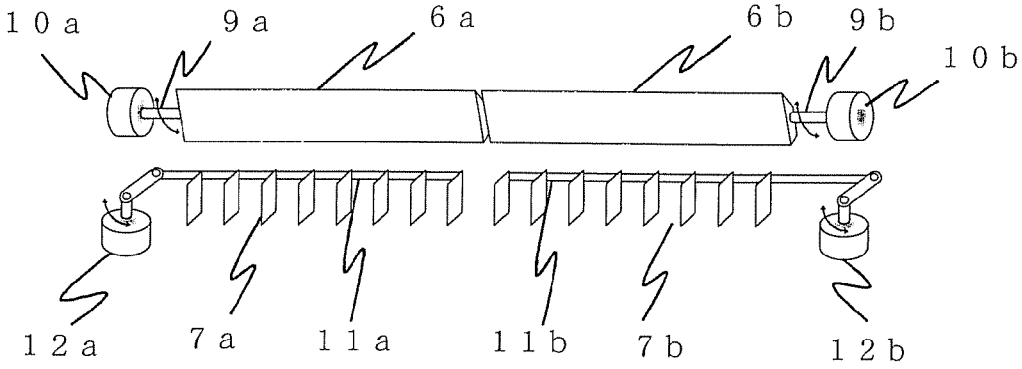
FIG. 2 shows the first embodiment and is a structure drawing of an air direction control driving unit showing a structure of a driving unit related to air direction control of the air-conditioner.
Figure 3:
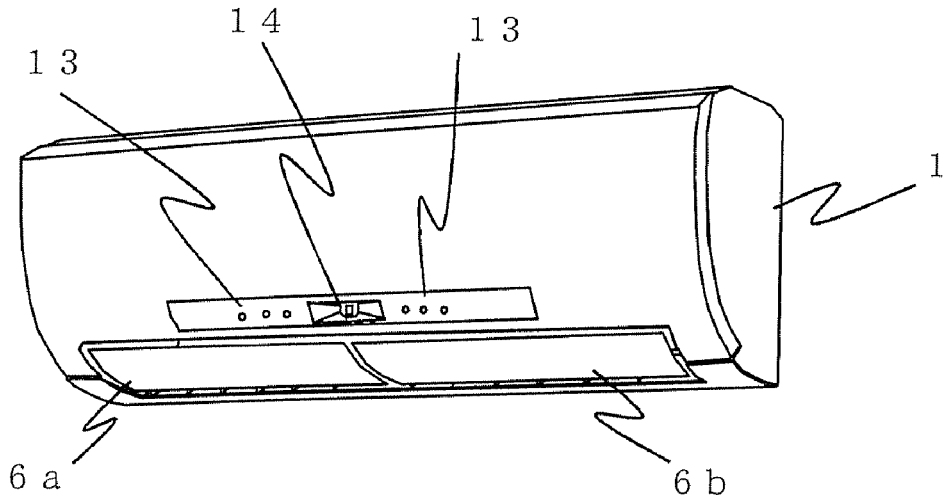
FIG. 3 shows the first embodiment and is a perspective view of an outline of the air-conditioner.
Figure 4:
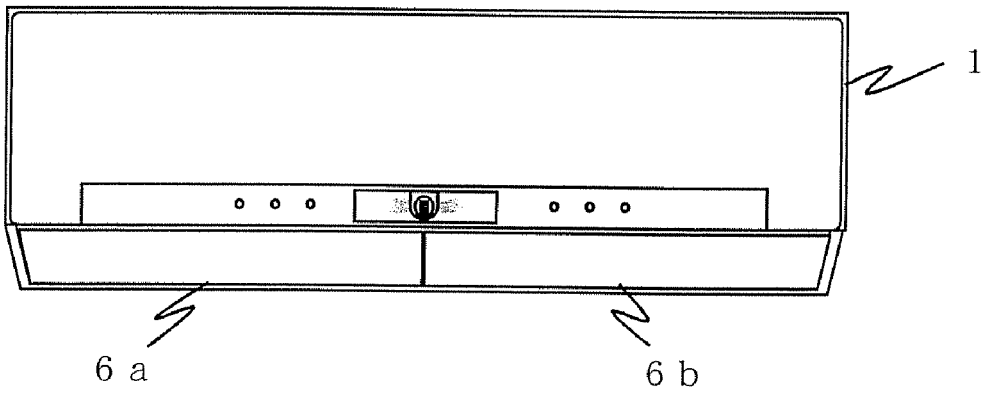
FIG. 4 shows the first embodiment and is a front view of the air-conditioner, omitting illustration of a left/right air direction control board.
Figure 5:
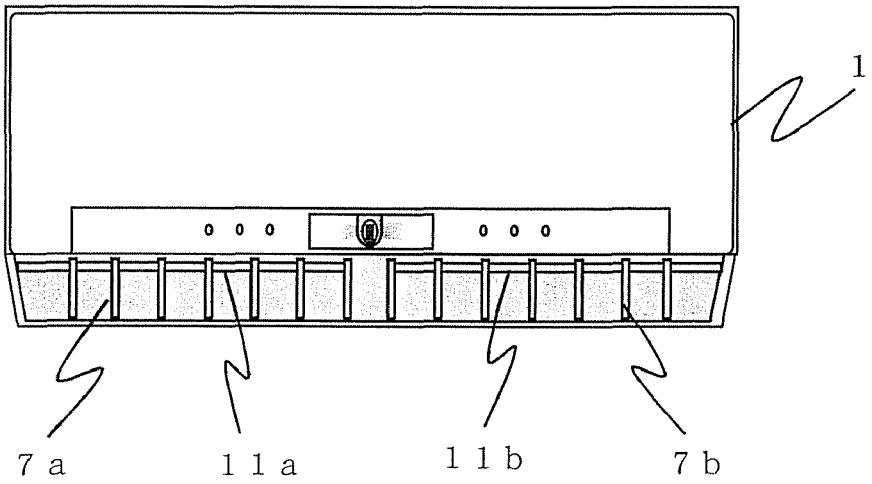
FIG. 5 shows the first embodiment and is a front view of the air-conditioner, omitting illustration of a up/down air direction control board.
Figure 6:
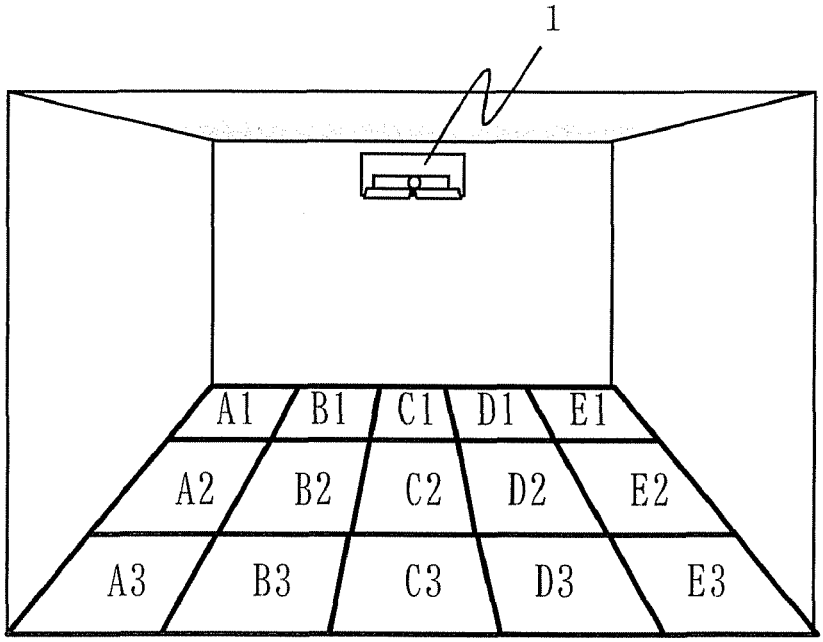
FIG. 6 shows the first embodiment and shows a room, in which the air-conditioner body is provided at an upper part of a wall, and also shows that the air-conditioner recognizes indoor space with status of 15 divided area sections.
Figure 7:
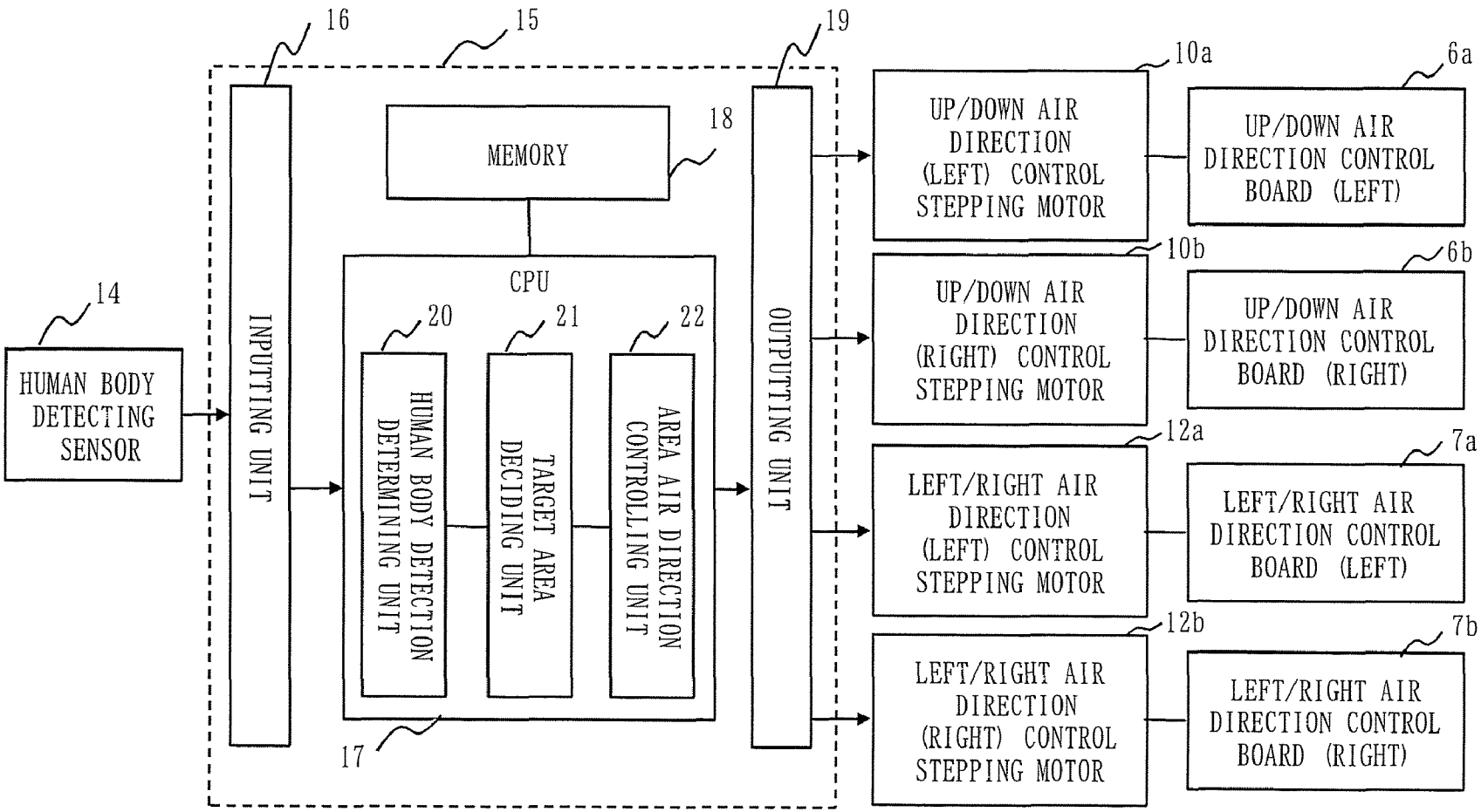
FIG. 7 shows the first embodiment and is a block diagram showing a microcomputer which forms a control device of the air-conditioner.
Figure 8:
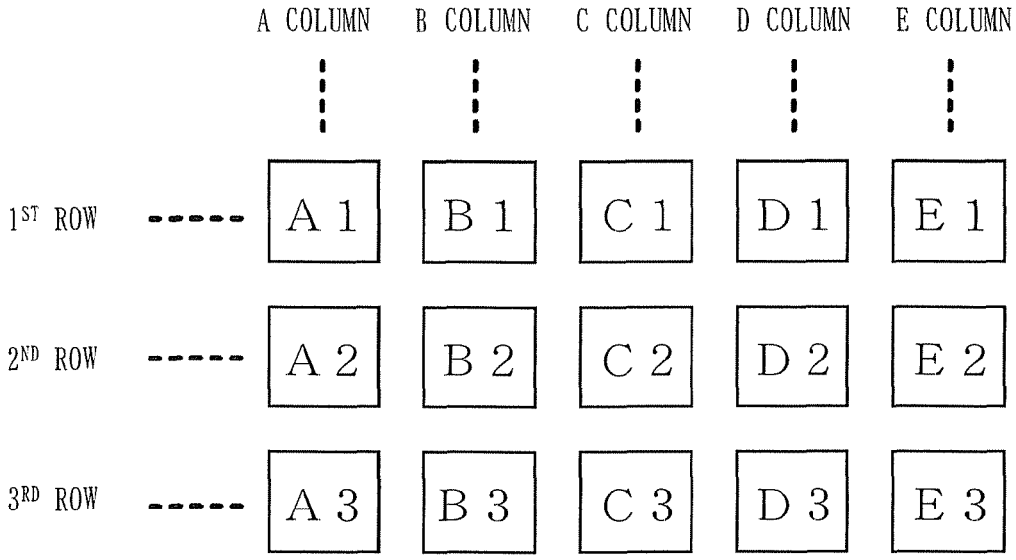
FIG. 8 shows the first embodiment and shows that the air-conditioner recognizes the indoor space with 15 divided area sections viewing from directly above.
Figure 9:
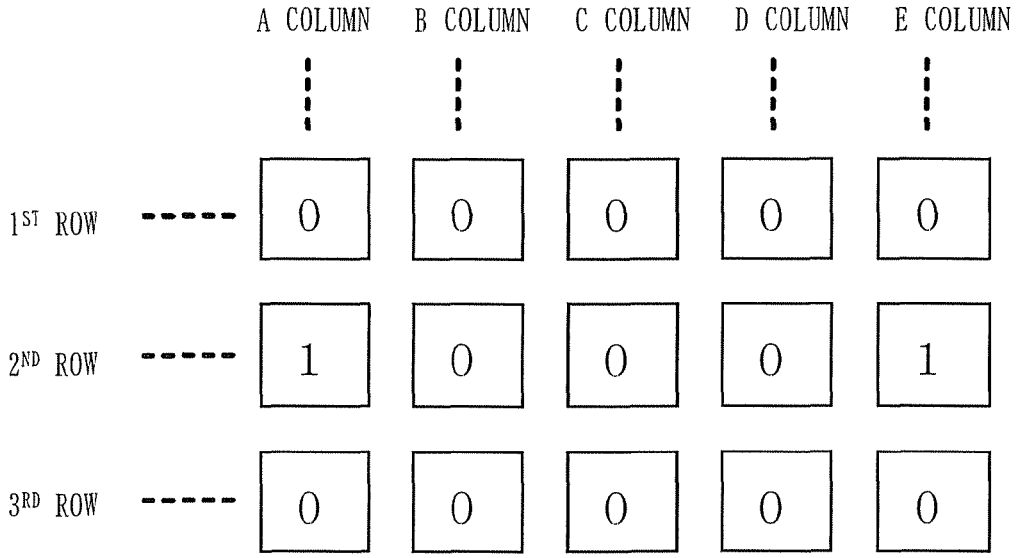
FIG. 9 shows the first embodiment and shows that the air-conditioner recognizes status when a human body is detected in two area sections of an area section A2 and an area section E2 out of a group of area sections formed of 15 two-dimensional area sections recognized by the air-conditioner.
Figure 10:
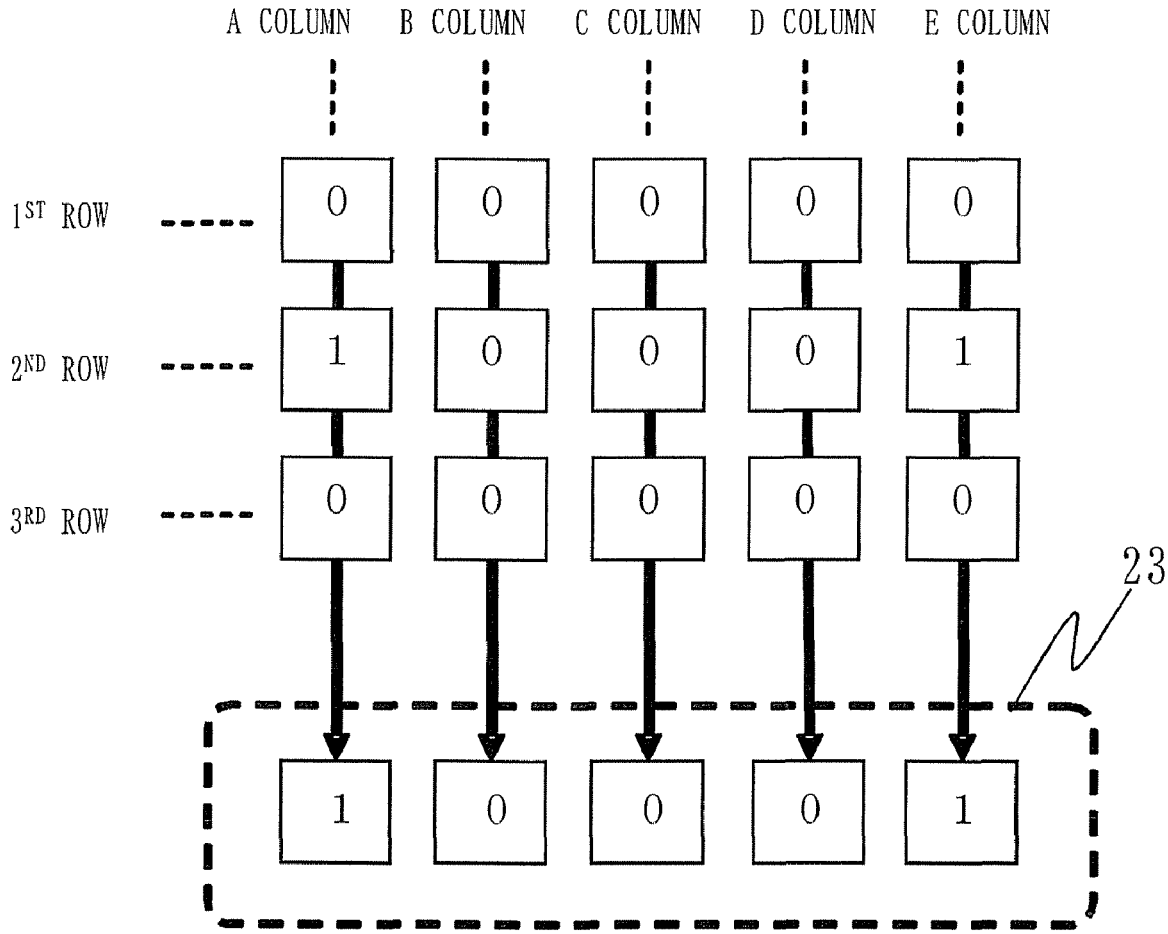
FIG. 10 shows the first embodiment and shows generation status of depth direction one-dimensional data to decide a setting value for driving a left/right air direction control stepping motor when the air-conditioner recognizes status when a human body is detected in two area sections of an area section A2 and an area section E2.
Figure 12:
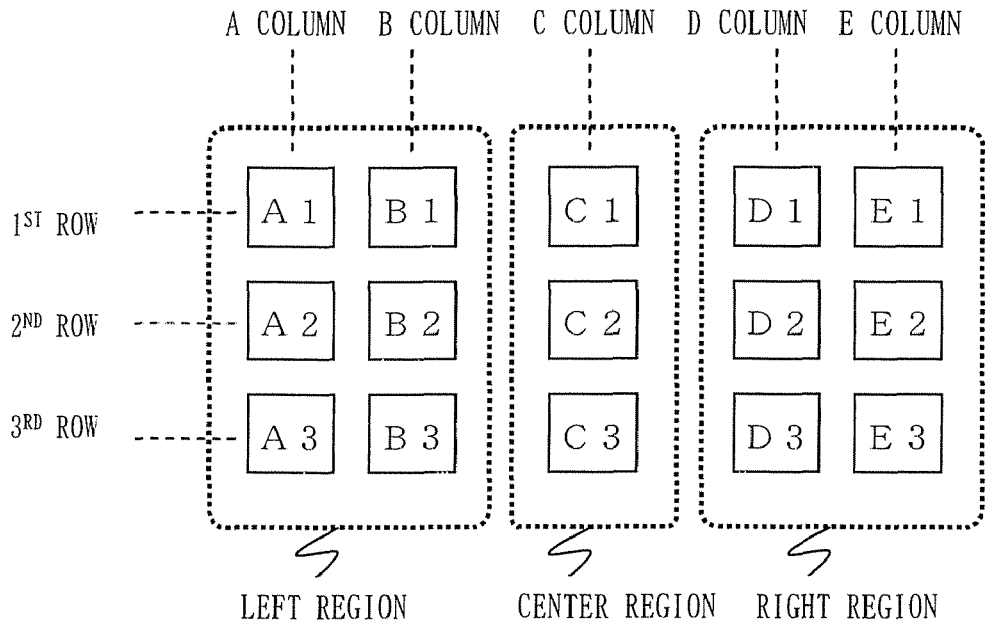
FIG. 12 shows the first embodiment and shows status of three regions divided from the group of area sections formed of 15 two-dimensional area sections in the left/right direction recognized by the air-conditioner.
Figure 13:
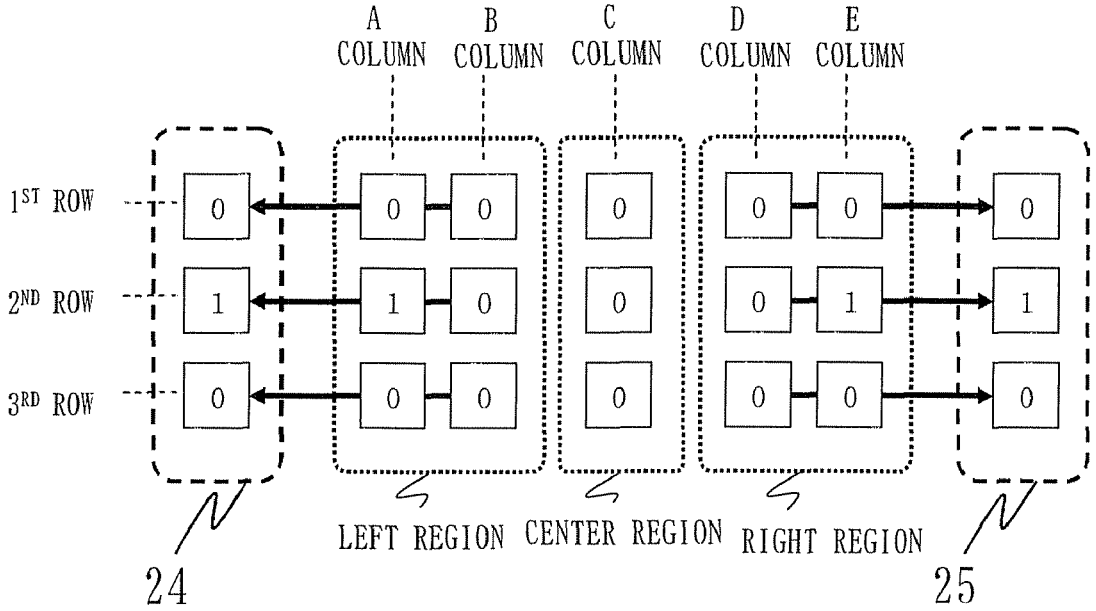
FIG. 13 shows the first embodiment and shows generation status of left/right direction one-dimensional data to decide a setting value for driving an up/down air direction control stepping motor when a human body is detected in two area sections of an area section A2 and an area section E2.
Figure 16:
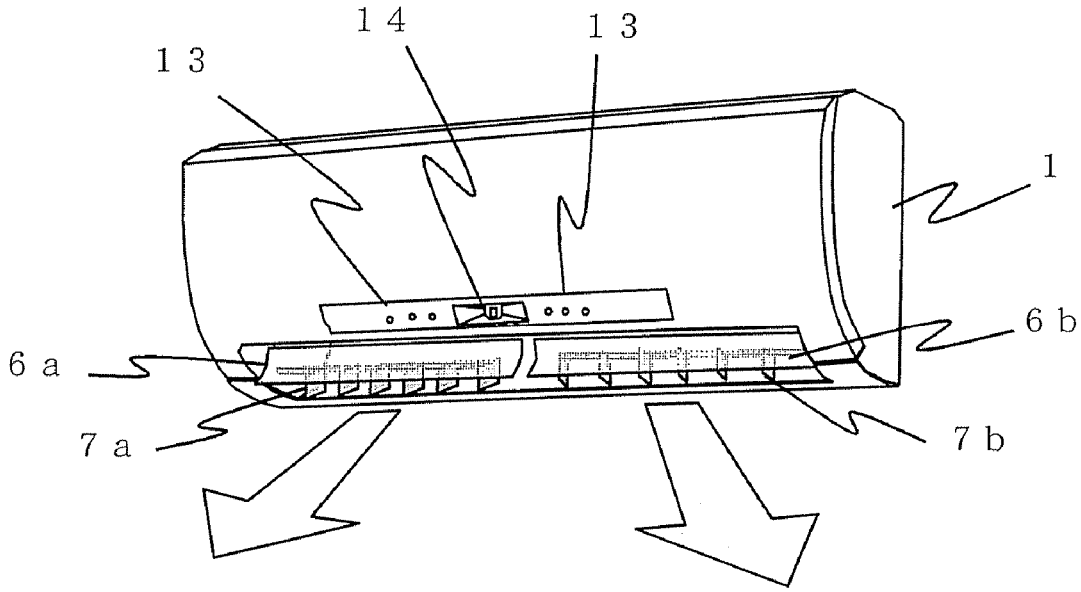
FIG. 16 shows the first embodiment and is a perspective view showing air direction operation when a human body is detected in two area sections of the area section A2 and the area section E2 of the air-conditioner.
Figure 17:
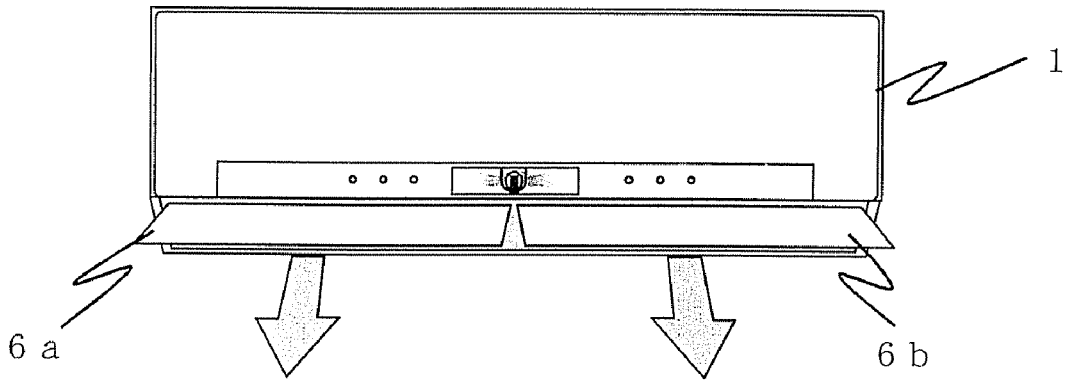
FIG. 17 shows the first embodiment and is a front view of the air-conditioner, omitting illustration of the left/right air direction control board, when the human body is detected in two area sections of the area section A2 and the area section E2 of the air-conditioner.
Figure 18:
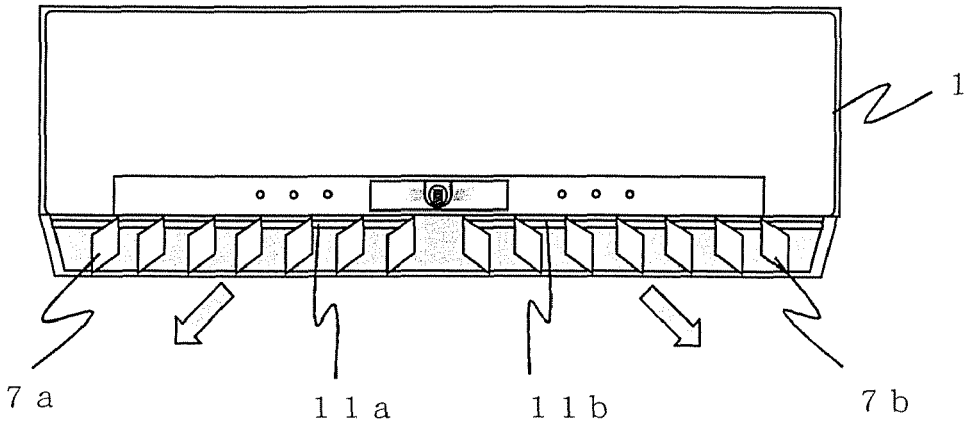
FIG. 18 shows the first embodiment and is a front view of the air-conditioner, omitting illustration of the up/down air direction control board, when the human body is detected in two area sections of the area section A2 and the area section E2 of the air-conditioner.
Figure 19:
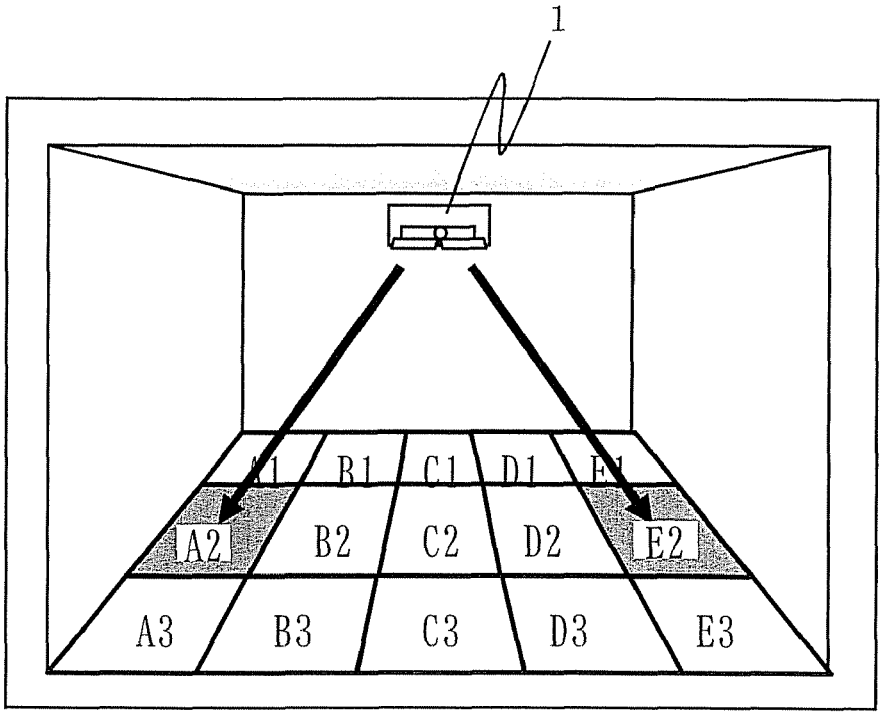
FIG. 19 shows the first embodiment and shows the room, in which the air-conditioner body is provided at an upper part of the wall, and shows the air direction operation status of the air-conditioner when the human body is detected in two area sections of the area section A2 and the area section E2.
Figure 20:
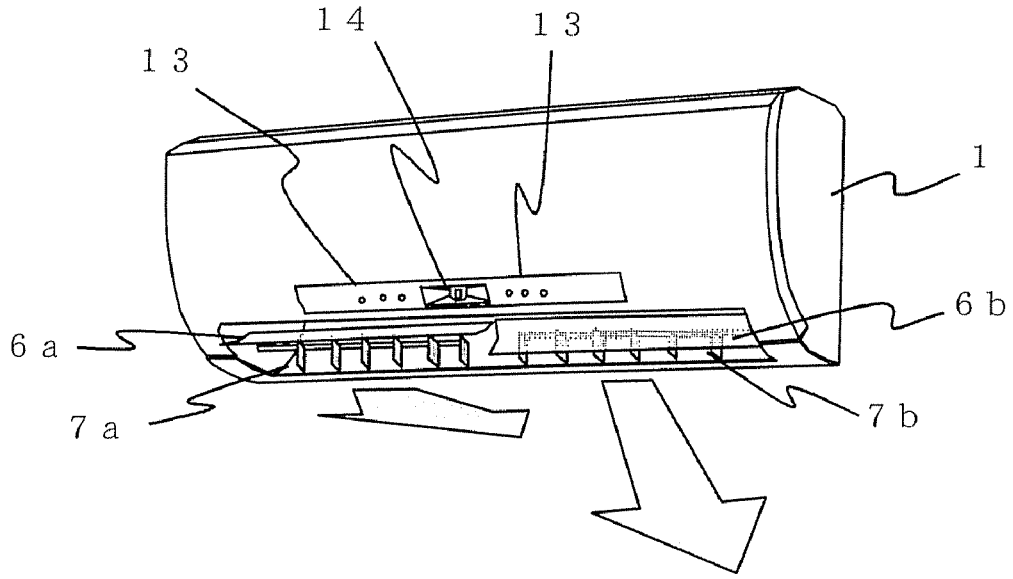
FIG. 20 shows the first embodiment and is a perspective view of the air-conditioner when the human body is detected in two area sections of the area section E1 and the area section E3.
Figure 21:
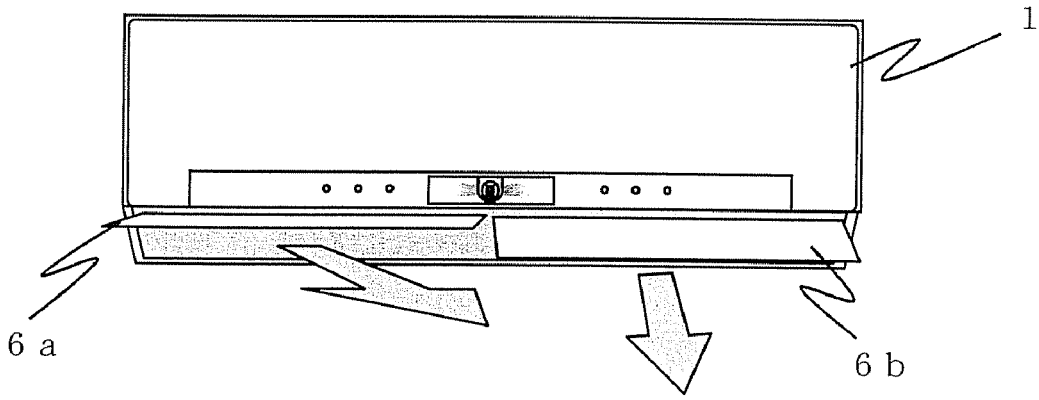
FIG. 21 shows the first embodiment and is a front view of the air-conditioner, omitting illustration of the left/right air direction control board, when the human body is detected in two area sections of the area section E1 and the area section E3.
Figure 22:
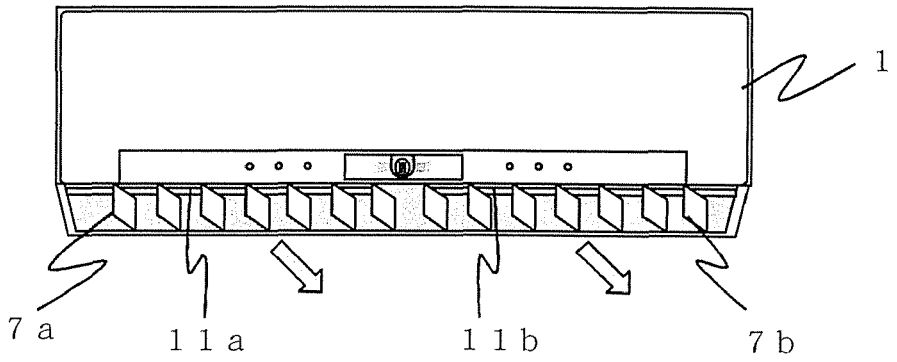
FIG. 22 shows the first embodiment and is a front view of the air-conditioner, omitting illustration of the up/down air direction control board, when the human body is detected in two area sections of the area section E1 and the area section E3.
Figure 23:
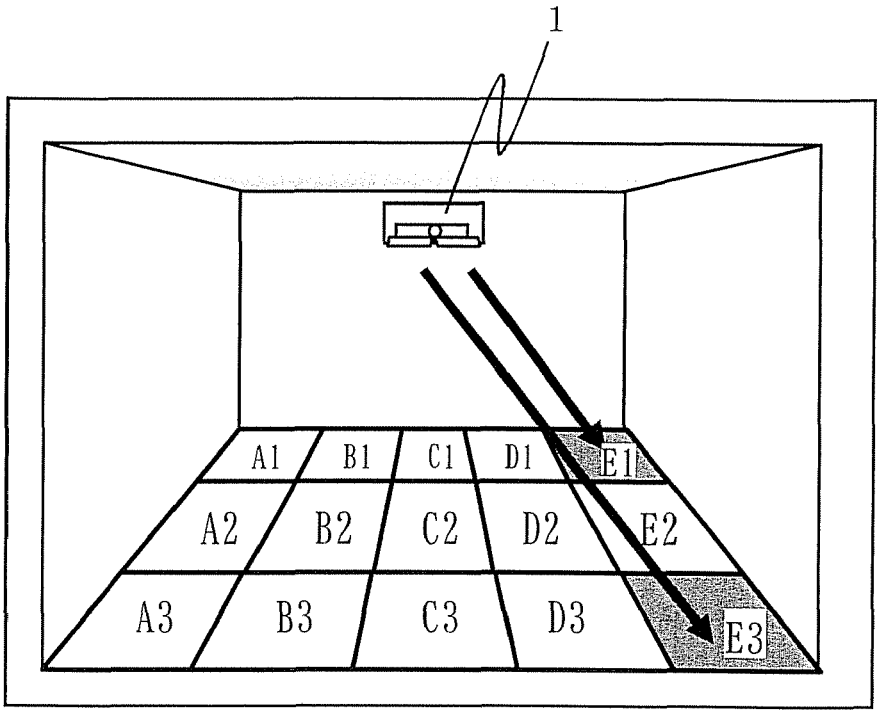
FIG. 23 shows the first embodiment and shows the room, in which the air-conditioner body is provided at an upper part of the wall, and shows the air direction operation status of the air-conditioner when the human body is detected in two area sections of the area section E1 and the area section E3.
Figure 24:
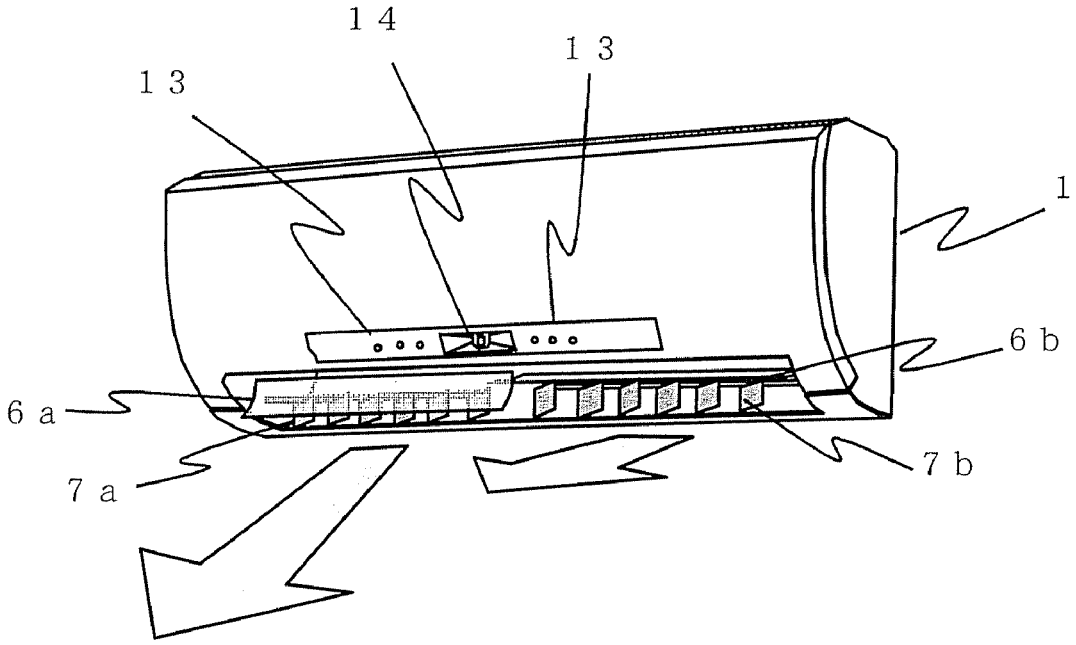
FIG. 24 shows the first embodiment and is a perspective view of the air-conditioner showing the air direction operation when the human body is detected in two area sections of the area section A1 and the area section A3.
Figure 25:
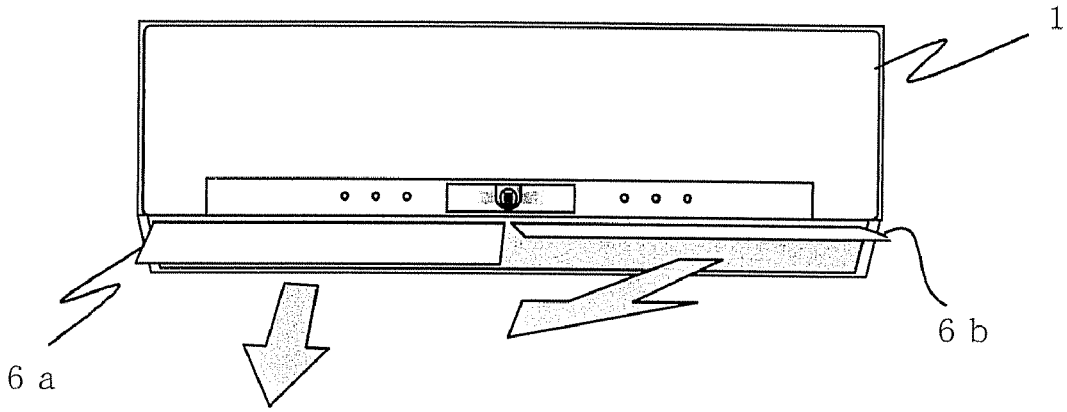
FIG. 25 shows the first embodiment and is a front view of the air-conditioner, omitting illustration of the left/right air direction control board, when the human body is detected in two area sections of the area section A1 and the area section A3.
Figure 26:
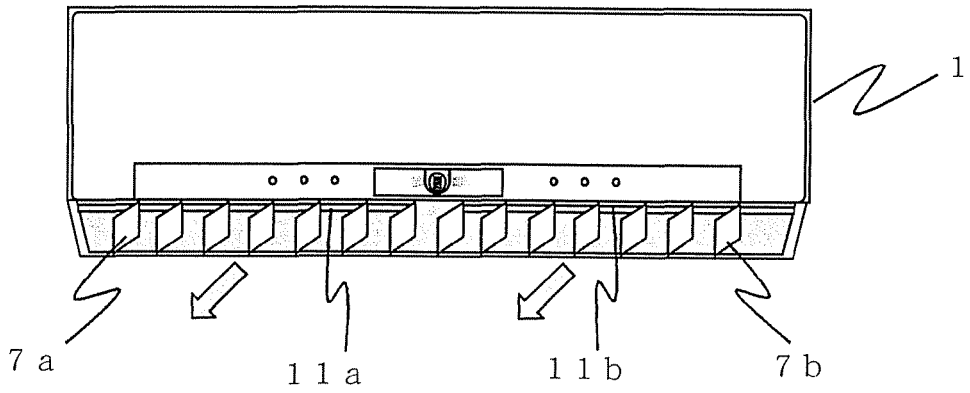
FIG. 26 shows the first embodiment and is a front view of the air-conditioner, omitting illustration of the up/down air direction control board, when the human body is detected in two area sections of the area section A1 and the area section A3.
Figure 27:
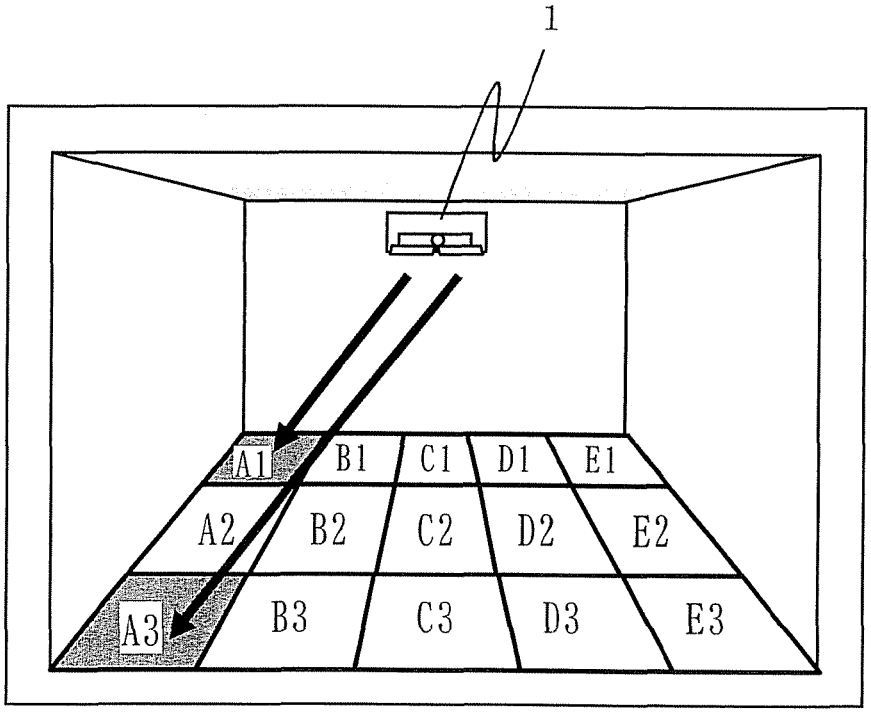
FIG. 27 shows the first embodiment and shows the room, in which the air-conditioner body is provided at an upper part of the wall, and shows the air direction operation status of the air-conditioner when the human body is detected in two area sections of the area section A1 and the area section A3.

FIGS. 1 through 27 show the first embodiment: FIG. 1 is a cross sectional view of an air-conditioner; FIG. 2 is a structure drawing of an air direction control driving unit showing a structure of a driving unit related to air direction control of the air-conditioner; FIG. 3 is a perspective view of an outline of the air-conditioner; FIG. 4 is a front view of the air-conditioner, omitting illustration of a left/right air direction control board; FIG. 5 is a front view of the air-conditioner, omitting illustration of a up/down air direction control board; FIG. 6 shows a room, in which the air-conditioner body is provided at an upper part of a wall, and also shows the air-conditioner recognizes indoor space with status of 15 divided area sections; FIG. 7 is a block diagram showing a microcomputer which forms a control device of the air-conditioner; FIG. 8 shows that the air-conditioner recognizes the indoor space with 15 divided area sections viewing from directly above; FIG. 9 shows that the air-conditioner recognizes status when a human body is detected in two area sections of an area section A2 and an area section E2 out of a group of area sections formed of 15 two-dimensional area sections recognized by the air-conditioner; FIG. 10 shows generation status of depth direction one-dimensional data to decide a setting value for driving a left/right air direction control stepping motor when the air-conditioner recognizes status when a human body is detected in two area sections of an area section A2 and an area section E2; FIG. 11 shows a left/right air direction setting table to decide the operation of the left/right air direction control board of the air-conditioner; FIG. 12 shows status of three regions divided from the group of area sections formed of 15 two-dimensional area sections in the left/right direction recognized by the air-conditioner; FIG. 13 shows generation status of left/right direction one-dimensional data to decide a setting value for driving a up/down air direction control stepping motor when a human body is detected in two area sections of an area section A2 and an area section E2; FIG. 14 shows an up/down air direction control boards (left)-(right) operation deciding table to decide the operation an up/down air direction control board (left) 6*a* and an up/down air direction control board (right) 6*b*; FIG. 15 shows an up/down air direction setting table to decide the operation of the up/down air direction control board of the air-conditioner; FIG. 16 is a perspective view showing air direction operation when a human body is detected in two area sections of the area section A2 and the area section E2 of the air-conditioner; FIG. 17 is a front view of the air-conditioner, omitting illustration of the left/right air direction control board, when the human body is detected in two area sections of the area section A2 and the area section E2 of the air-conditioner; FIG. 18 is a front view of the air-conditioner, omitting illustration of the up/down air direction control board, when the human body is detected in two area sections of the area section A2 and the area section E2 of the air-conditioner; FIG. 19 shows the room, in which at an upper part of the wall the air-conditioner body is provided, and shows the air direction operation status of the air-conditioner when the human body is detected in two area sections of the area section A2 and the area section E2; FIG. 20 is a perspective view of the air-conditioner when the human body is detected in two area sections of the area section E1 and the area section E3; FIG. 21 is a front view of the air-conditioner, omitting illustration of the left/right air direction control board, when the human body is detected in two area sections of the area section E1 and the area section E3; FIG. 22 is a front view of the air-conditioner, omitting illustration of the up/down air direction control board, when the human body is detected in two area sections of the area section E1 and the area section E3; FIG. 23 shows the room, in which the air-conditioner body is provided at an upper part of the wall, and shows the air direction operation status of the air-conditioner when the human body is detected in two area sections of the area section E1 and the area section E3; FIG. 24 is a perspective view of the air-conditioner showing the air direction operation when the human body is detected in two area sections of the area section A1 and the area section A3; FIG. 25 is a front view of the air-conditioner, omitting illustration of the left/right air direction control board, when the human body is detected in two area sections of the area section A1 and the area section A3; FIG. 26 is a front view of the air-conditioner, omitting illustration of the up/down air direction control board, when the human body is detected in two area sections of the area section A1 and the area section A3; and FIG. 27 shows the room, in which the air-conditioner body is provided at an upper part of the wall, and shows the air direction operation status of the air-conditioner when the human body is detected in two area sections of the area section A1 and the area section A3.

As shown in FIG. 1, an air-conditioner body 1 includes an indoor fan 2 which sucks air and blows the air to the inside of the air-conditioner body 1, a pre-filter 8 which removes powder dust, etc. included in the suction air, a first indoor heat exchanger 5*a*, a second indoor heat exchanger 5*b*, a third indoor heat exchanger 5*c*, and a fourth indoor heat exchanger 5*d*.

The upper surface of the air-conditioner body 1 is provided with an inlet 3 which sucks indoor air. An outlet 4 provided at the lower part of the air-conditioner body 1 and existing extendedly in the left/right direction, namely, the longitudinal direction of the air-conditioner body 1 includes an up/down air direction control board 6 and a left/right air direction control board 7.

The indoor fan 2 is rotated and driven by an indoor fan motor (not illustrated). By this operation, the indoor air is sucked into the air-conditioner body 1 from the inlet 3, the indoor air from which powder dust, etc is removed by the pre-filter 8 is heat-exchanged when passing the first heat exchanger 5*a*, the second heat exchanger 5*b*, the third indoor heat exchanger 5*c*, and the fourth indoor heat exchanger 5*d* to become conditioned air.

The heat-exchanged conditioned air then passes the indoor fan 2, is rectified by the left/right air direction control board 7 and the up/down air direction control board 6 provided at the outlet 4 in upward/downward left/right direction, and blown out to the indoor space from the air-conditioner body 1.

Further, in the first embodiment, since an example is shown as the air-conditioner which can adjust air temperature, the air-conditioner includes the first indoor heat exchanger 5*a*, the second indoor heat exchanger 5*b*, the third indoor heat exchanger 5*c*, and the fourth indoor heat exchanger 5*d*. However, the present invention relates to the air direction control method of blowing airflow, so that it is not necessary to mount a heat exchanger. It is needless to say that the present invention is applicable to the air conditioner which does not mount the heat exchanger, for example, an air purifier.

Further, as shown in FIG. 2, the up/down air direction control board 6 and the left/right air direction control board 7 are respectively separated into left and right, which can be operated independently. The up/down air direction control board 6 includes an up/down air direction control board (left) 6*a* and an up/down air direction control board (right) 6*b*. The up/down air direction control board (left) 6*a* is coupled to an up/down air direction (left) control stepping motor 10*a* with an up/down air direction control board (left) link rod 9*a*. Rotation of the up/down air direction (left) control stepping motor 10*a* causes the up/down air direction control board (left) 6*a* to change its angle, which can adjust the up/down air direction and rectify the left half of airflow blown out from the air-conditioner body 1.

Similarly, the up/down air direction control board (right) 6*b* is coupled to an up/down air direction (right) control stepping motor 10*b* with an up/down air direction control board (right) link rod 9*b*. Rotation of the up/down air direction (right) control stepping motor 10*b* causes the up/down air direction control board (right) 6*b* to change its angle, which can adjust the up/down air direction and rectify the right half of airflow blown out from the air-conditioner body 1.

The left/right air direction control board 7 includes a left/right air direction control board (left) 7*a* and a left/right air direction control board (right) 7*b*. Although the left/right air direction control board (left) 7*a* includes plural air direction control boards, the plural air direction control boards are coupled by a left/right air direction control board (left) link rod 11*a*, and they carry out the same operation. A left/right air direction (left) control stepping motor 12*a* is coupled to the end of the left/right air direction control board (left) link rod 11*a*, and rotation of the left/right air direction (left) control stepping motor 12*a* causes the left/right air direction control board (left) 7*a* to change its angle, which can adjust left/right air direction angle and rectify the left half of airflow blown out from the air-conditioner body 1.

Similarly, although the left/right air direction control board (right) 7*b* includes plural air direction control boards, the plural air direction control boards are coupled by a left/right air direction control board (right) link rod 11*b*, and they carry out the same operation. A left/right air direction (right) control stepping motor 12*b* is coupled to the end of the left/right air direction control board (right) link rod 11*b*, and rotation of the left/right air direction (right) control stepping motor 12*b* causes the left/right air direction control board (right) 7*b* to change its angle, which can adjust left/right air direction angle and rectify the right half of airflow blown out from the air-conditioner body 1.

Further, as shown in FIG. 3, the air-conditioner body 1 is provided with a human body detecting sensor 14 for detecting a location where a human body exists in the indoor space and a main body displaying unit 13 for notifying the user of operation status of the air-conditioner.

In the first embodiment, in order to make the operation understandable, for explaining with an example in which airflow is directed to the location in which a human body is detected, a human body detecting sensor 14 is provided and an area section for air-conditioning (for conditioning airflow) is specified using the human body detecting sensor 14. Here, the human body detecting sensor 14 can be an infrared detecting sensor which detects the human body by detecting infrared ray radiated from the human body or a sensor which detects the human body by directly photographing an image and extracting the human body from the photographed image, namely, the present embodiment does not limit the type of the sensor. From the beginning, the present invention is for an air direction control method of blowing airflow, so that it is not essential to mount the human body detecting sensor 14, and the invention is applicable to the air-conditioner for which the user specifies the area where the user desires air conditioning by remote controller. The present invention does not limit a method to specify the area section for air conditioning; the area section for air conditioning can be specified by another method, which is not limited to the human body detecting sensor 14 or the operation of the remote controller by the user.

Further, FIGS. 3 through 5 show status in which the air-conditioner body 1 halts. FIG. 3 is a stereoscopically perspective view of the air-conditioner body 1. FIG. 4 omits illustration of the left/right air direction control board 7 in order to make the operation status of the up/down air direction control board (left) 6*a* and the up/down air direction control board (right) 6*b* understandable. FIG. 5 omits illustration of the up/down air direction control board 6 in order to make the operation status of the left/right air direction control board (left) 7*a* and the left/right air direction control board (right) 7*b* understandable.

FIG. 6 show a room (indoor) in which the air-conditioner body 1 is provided. In addition, it shows status in which the air-conditioner body 1 recognizes the indoor space of the room by dividing 15 area sections with 3 in the depth direction multiplied by 5 in the left/right direction. Here, the depth direction of the space of the room means a direction which is orthogonal to the longitudinal direction of the air-conditioner body 1, and the left/right direction means a direction which is parallel to the longitudinal direction of the air-conditioner body 1. In the air-conditioner, the indoor space is divided into 15 area sections, and a group of area sections is formed by developing the 15 area sections two-dimensionally. Each of the group of 15 area sections is two-dimensional, and the group of area sections is formed by 15 two-dimensional area sections with 3 rows in the depth direction and 5 columns in the left/right direction.

The closest row (the 1st row, hereinafter) to the air-conditioner body 1 is formed of five area sections of A1, B1, C1, D1, and E1.

The farthest located row (the 3rd row, hereinafter) from the air-conditioner body 1 is formed of five area sections of A3, B3, C3, D3, and E3.

The 2nd row located between the 1st and the 3rd rows is formed of five area sections of A2, B2, C2, D2, and E2.

A, B, C, D, and E show columns in the space of this room. It means, for example, the A column is formed of three area sections of A1, A2, and A3.

When the air-conditioner body 1 is set as a reference, the A column is the leftmost located column facing the air-conditioner body 1, the C column is the column located at the front of the air-conditioner body 1, the E column is the rightmost located column facing the air-conditioner body 1, the B column is the column located between the A and the C columns, and the D column is the column located between the C and the E columns.

Further, in the first embodiment, the number of area sections of the group of area sections is fifteen; however, the number of sections is not limited by the present invention, but the number can be set arbitrarily. In principle, the more the total number of area sections is made, the more precisely and with the higher precision airflow blown out from the air-conditioner can be controlled, which improves comfort of the user.

Here, a circuit configuration of a microcomputer embedded in the control device 15 will be explained with reference to FIG. 7. In FIG. 7, the control device 15 includes an inputting unit 16, a CPU 17, a memory 18, and an outputting unit 19.

Further, inside of the CPU 17, a human body detection determining unit 20, a target area deciding unit 21, and a area air direction controlling unit 22 are embedded.

The inputting unit 16 is an input circuit for receiving an input signal from the human body detecting sensor 14. Here, an input from other than the human body detecting sensor 14 is omitted; however, as a matter of course, an input is not limited to this example, but it is also possible to input a signal other than the signal from the human body detecting sensor 14 such as a remote controller signal and the room temperature detecting sensor, etc.

The CPU 17 is a decision making part for various calculation process, air direction determination, etc. by referencing the contents stored in the memory 18. The human body detecting signal inputted through the inputting unit 16 is first inputted to a human body detection determining unit 20 in the CPU 17.

Here, the memory 18 is a memory part for storing the operation setting status of the air-conditioner, or operation constants, etc. of various programs or air direction setting table, etc. The above group of area sections formed by fifteen two-dimensional area sections is also stored in the memory beforehand.

The human body detection determining unit 20 of the CPU 17 determines which area section the human body is detected out of the group of area sections formed of the fifteen two-dimensional area sections which has been explained in FIG. 6 based on the inputted human body detecting signal. Since the present invention is not related to the human body detecting method, a detailed explanation of the method is omitted.

Receiving the result of the area section in which the human body is detected determined by the human body detection determining unit 20, a target area deciding unit 21 decides which direction blowout airflow is directed out of the group of area sections formed of fifteen two-dimensional area sections which has been explained in FIG. 6. Namely, an area section is decided for air-conditioning target.

In order to rectify the blowing airflow from the air-conditioner body 1 directed to the target area decided by the target area deciding unit 21, the area air direction controlling unit 22 decides how to control each of the up/down air direction (left) control stepping motor 10*a*, the up/down air direction (right) control stepping motor 10*b*, the left/right air direction (left) control stepping motor 12*a*, and the left/right air direction (right) control stepping motor 12*b*, and passes the decided result to an outputting unit 19.

The up/down air direction (left) control stepping motor 10*a*, the up/down air direction (right) control stepping motor 10*b*, the left/right air direction (left) control stepping motor 12*a*, and the left/right air direction (right) control stepping motor 12*b* are connected to the outputting unit 19. Each stepping motor operates based on the operation contents decided by the area air direction controlling unit 22.

To each of the stepping motors, the up/down air direction control board (left) 6*a*, the up/down air direction control board (right) 6*b*, the left/right air direction control board (left) 7*a*, and the left/right air direction control board (right) 7*b* are respectively coupled. Then, the angle of each air direction control board is changed according to the operational rotation volume of each stepping motor, and finally, the rectified airflow is blown out towards the targeted area section from the air-conditioner body 1.

Although FIG. 7 only shows necessary and minimum elements for explaining the first embodiment, the elements are not limited to these, but other elements necessary for the operation of the air-conditioner do not undermine any effect of the present invention.

Next, the operation of the air-conditioner of the first embodiment will be explained with reference to FIGS. 8 through 27.

In the air-conditioner which is structured as discussed above, FIG. 8 shows the group of area sections formed of fifteen two-dimensional area sections which the air-conditioner recognizes shown in FIG. 6. Here, for example, if the human body detection determining unit 20 determines the human body detected location (in this embodiment, location where the human body detecting sensor 14 detects existence of a human) is two area sections of A2 and E2, the determined result of the target area deciding unit 21 is as shown in FIG. 9. Namely, "1" is set in the area sections of A2 and E2, and "0" is set in the other remaining thirteen area sections.

Namely, the target area deciding unit 21 outputs the determined result for each area section of the group of area sections stored in the memory 18 beforehand by setting a value "1" to the area section for the target of air conditioning, setting a value "0" to the area section which is not the target of air conditioning, that is, setting only one of binary values of "0" and "1" for each of the all area sections. Here, the group of area sections stored in the memory 18 beforehand can be used as discussed above; however, a group of area sections can be generated by the control device 15 for each operation of the air-conditioner.

Next, the area air direction controlling unit 22 decides rotation amount of each of the stepping motors necessary for setting the angle of the up/down air direction control board 6, the left/right air direction control board 7, and each air direction control board to the decided angle for rectifying the blowing airflow from the air-conditioner body 1 towards the target area section of air conditioning decided by the target area deciding unit 21.

First, a method to decide the set angle of the left/right air direction control board 7 will be explained.

In order to decide the set angle of the left/right air direction control board 7, the area air direction controlling unit 22 carries out calculation process as shown in FIG. 10 based on the setting status of the area section which is the target of air conditioning of FIG. 9 and calculates data for deciding the operation of the left/right air direction control board.

This data calculation method is carried out by calculating for each column a logical sum of each area section in the depth direction in the group of area sections. Here, the logical sum means a function carrying out a calculation process which returns a result of 0 if, among a group of plural values, each takes either of binary values of 0 and 1, all values of the group of values are 0, and returns a result of 1 if at least one of the group of values is 1. For example, when focusing on three area sections of A1, A2, and A3 which form the A column, A1=0, A2=1, and A3=0. Accordingly, the calculated result of the logical sum of the values of three area sections which form the A column is 1, since A2 is the value of 1.

Similarly, the calculated result of the logical sum of values of three area sections B1, B2, and B3 which form the B column is 0, since all the values of three area sections are 0.

Subsequently, through similar calculation process done for the C column, the D column, and the E column, the final result is obtained as shown in a block with a broken line in FIG. 10. A group of data values in the broken lined block is defined as depth direction one-dimensional data 23, since the group of data developed two-dimensionally as shown in FIG. 9 is calculated in the depth direction as shown in FIG. 10 to make the data be one-dimensional data status.

Next, the area air direction controlling unit 22 refers to a left/right air direction setting table shown in FIG. 11 stored in the memory 18, extracts a case which matches the result of the depth direction one-dimensional data 23 calculated, and decides the final setting angle of the left/right air direction control board 7.

The left/right air direction setting table of FIG. 11 is a list which defines the setting angles of the left/right air direction control board (left) 7*a* and the left/right air direction control board (right) 7*b* according to value of each column of the depth direction one-dimensional data 23 and which is stored in the memory 18.

In the table shown in FIG. 1, if there exists a targeted area section such as the number 2 through the number 32, namely, if at least one column has a value of 1, the air direction is set to rectify the airflow towards the targeted area section. However, if there exists no targeted area section as the case of number 1, namely, every column has a value of 0, the air direction angle is set so as to make the whole indoor space air-conditioned similarly to the case of number 32 in which the targeted area section exist in all columns, namely, every column has a value of 1.

Further, if three or more columns are targeted area sections such as the case of number 22 (there are three or more columns having a value of 1), the air direction angle is set towards intermediate of them; however, it is possible to swing in the left/right direction so as to rectify blowing airflow to direct alternately to each column where the targeted area section exists. That is, in the case of number 22, values are 1, 0, 1, 0, 1 in order of the A column to the E column, so that the left/right air direction control board (left) 7*a* is made swing so as to rectify airflow to blow alternately to the A column and the C column, and the left/right air direction control board (right) 7*b* is made swing so as to rectify airflow to blow alternately to the C column and the E column.

As shown in FIG. 10, the result of the depth direction one-dimensional data 23 is 1, 0, 0, 0, 1 in order of the A column to the E column, which matches contents written in the row of number 18 in the left/right air direction setting table of FIG. 11.

In the case of number 18, the setting angle of the left/right air direction control board (left) 7*a* is directed to left, and the setting angle of the left/right air direction control board (right) 7*b* is directed to right. The rotation amount of the stepping motors corresponding to each result is decided based on the rotation amount for each setting angle stored in the memory 18 beforehand, and the result is passed to the outputting unit 19.

The outputting unit 19 rotates the left/right air direction (left) control stepping motor 12*a* and the left/right air direction (right) control stepping motor 12*b* based on the rotation amount of each stepping motor for left/right air direction control passed from the area air direction controlling unit 22. As a result of this, the left/right air direction control board (left) 7*a* and the left/right air direction control board (right) 7*b* are set their setting angle so as to rectify the airflow directed to a targeted area sections.

Next, a method to decide the setting angle of the up/down air direction control board 6 will be explained.

In order to decide the setting angle of the up/down air direction control board 6, the area air direction controlling unit 22 first divides the assigned status of each area section of the group of area sections shown in FIG. 8 into a left region, a center region, and a right region as shown in FIG. 12.

That is, the left region is formed of six area sections A1, A2, A3, B1, B2, and B3 of the A column and the B column. The center region is formed of three area sections C1, C2, and C3 of the C column. The right region is formed of six area sections D1, D2, D3, E1, E2, and E3.

Next, the area air direction controlling unit 22 calculates a logical sum for each area section by each column in the left/right direction for each area. That is, since the area sections of A2 and E2 are decided as targeted area, and the values of the two area sections A1 and B1 are both "0" in the left region as shown in FIG. 13, the calculated result of the logical sum is 0.

Similarly, as for two area sections of A2 and B2 in the second row, A2=1 and B2=0; since A2 is "1", the calculated result of the logical sum is 1.

Since the values of two area sections of A3 and B3 in the 3$^{rd}$ row are both "0", the calculated result of the logical sum is 0. As a result of this, the result of calculation process in the left region becomes 0, 1, 0 from the 1$^{st}$ row to the 3$^{rd}$ row, namely, they are the result included in the broken lined block in the left side of FIG. 13. The group of data values included in the block is defined as left/right direction one-dimensional data (left region) 24, since each data in the left region is calculated in the left/right direction for each row so as to make one-dimensional data status.

Similarly, in the right region, left/right direction one-dimensional data (right region) 25 is obtained as the calculated result as shown in a broken lined block in the right side of FIG. 13.

As for the center region, since there exists only one column of the C column, data of three area sections of C1, C2, and C3 of the C column are directly the left/right direction one-dimensional data (center region).

Subsequently, by carrying out the calculation process to obtain the logical sum for all area sections in each area out of three regions of the left region, the center region, and the right region, the area air direction controlling unit 22 determines whether there exists an area section to be targeted in each region.

For example, the left region is determined to be 1 since the area section A2 is 1 in the left region as shown in FIG. 13, similarly the center region is 0 since there is no targeted area section in the center region, and the right region is 1.

The area air direction controlling unit 22 extracts data which matches the determined result from the up/down air direction control board (left)-(right) operation deciding table shown in FIG. 14 which is stored in the memory 18, and decides region to be assigned to each of the up/down air direction control boards 6. FIG. 14 is an up/down air direction control board (left)-(right) operation deciding table for classifying a targeted area section exists in each of the left region, the center region, and the right region and deciding the operation of the up/down air direction control board (left) 6*a* and the up/down air direction control board (right) 6*b* for each classification.

The right region in this table means to handle rectification of airflow to be blown directed to the targeted area section existing in the right region, namely, to use the left/right direction one-dimensional data (right region) 25 for the right region. Similarly, the left region means to handle rectification of airflow to be blown directed to the targeted area section existing in the left region, namely, to use the left/right direction one-dimensional data (left region) 24 for the left region. The center region means to handle rectification of airflow to be blown directed to the targeted area section existing in the center region, namely, to use the left/right direction one-dimensional data for the center region.

Further, "left+center region" means to handle rectification of airflow to be blown directed to the targeted area section existing in the left region and the center region, namely, to use left/right direction one-dimensional data which is obtained as a result of calculating the logical sum of the left/right direction one-dimensional data (left region) 24 for the left region and the left/right direction one-dimensional data for the center region along the row.

Similarly, "right+center region" means to handle rectification of airflow to be blown directed to the targeted area section existing in the right region and the center region, namely, to use left/right direction one-dimensional data which is obtained as a result of calculating the logical sum of the left/right direction one-dimensional data (right region) 25 for the right region and the left/right direction one-dimensional data for the center region along the row.

Further, such as the cases of numbers 2 through 8 shown in FIG. 14, if there exists a targeted area section in either region (when a value of 1 exists in either cell), it is set to handle that region. If no targeted area section exists in any region such as the case of number 1 (every cell has a value of 0), it is set to be able to handle the whole indoor region like the case of member 8 where targeted area sections exist in all regions (every cell has a value of 1).

Here, since the result is the left region=1, the center region=0, and the right region=1, the contents written in the row of number 6 in the table of FIG. 14 matches the case. The number 6 specifies that the up/down air direction control board (left) 6*a* handles the left region, and the up/down air direction control board (right) 6*b* handles the right region. Accordingly, the up/down air direction control board (left) 6*a* uses the left/right direction one-dimensional data (left region) 24, and the up/down air direction control board (right) 6*b* uses the left/right direction one-dimensional data (right region) 25.

Next, the area air direction controlling unit 22 extracts data which matches the left/right direction one-dimensional data used by each of the up/down air direction control boards 6 from the up/down air direction setting table shown in FIG. 15 stored in the memory 18 and decides the final setting angle of each of the up/down air direction control board 6.

The up/down air direction setting table of FIG. 15 is a list defining the setting angle of the up/down air direction control board 6 according to a value of each row of the left/right direction one-dimensional data, which is applied to both up/down air direction control boards 6 of the up/down air direction control board (left) 6*a* and the up/down air direction control board (right) 6*b*.

As for the up/down air direction No. 1 through the up/down air direction No. 5, here, the up/down air direction No. 1 is the setting angle to blow in the horizontal direction, the up/down air direction No. 5 is the setting angle to blow the most downwardly, the up/down air direction No. 2 and the up/down air direction No. 3 are defined as the setting angles set between the up/down air direction No. 1 and the up/down air direction No. 5 in order of numbers.

Further, in the table shown in FIG. 15, when a targeted area section exists in either row such as the cases of number 2 through number 8, namely, when the value of 1 exists in at least either row, the air direction angle is set so as to rectify the blowing airflow directed to that row. When no targeted area section exists in either row such as the case of number 1, similarly to the case of number 8 in which targeted area sections exist in all rows, namely, when all rows have the value of 1, the air direction angle is set so as to make the whole indoor space air-conditioned.

Further, when the targeted area sections exist in two or more rows such as the case of number 6, namely, two or more rows having the value of 1 exist, the air direction angle is set so as to direct to the middle of them; however, it is possible to set to make swing in the up/down direction in order to rectify the blowing airflow alternately directed to respective rows in which the targeted area sections exist. That is, since the case of number 6 reads 1, 0, 1 from the $1^{st}$ row to the $3^{rd}$ row, it is set to make swing the up/down air direction control board 6 in order to rectify the blowing airflow alternately directed to the $1^{st}$ row and the $3^{rd}$ row.

Here, the up/down air direction control board (left) 6*a* uses the left/right direction one-dimensional data (left region) 24, the left/right direction one-dimensional data (left region) 24 reads 0, 1, 0 from the $1^{st}$ row to the $3^{rd}$ row, which matches the case of number 3 in the table of FIG. 15. Since the setting angle of the up/down air direction control board 6 is specified as the up/down air direction No. 3 in the case of number 3, the up/down air direction control board (left) 6*a* is set to the setting angle of the up/down air direction No. 3 finally.

Similarly, the up/down air direction control board (right) 6*b* uses the left/right direction one-dimensional data (right region) 25, and the values are 0, 1, 0, so that the setting angle is set to the up/down air direction No. 3 specified in the case of number 3 in the table of FIG. 15.

When the setting angle is decided, the area air direction controlling unit 22 decides the rotation amount of the stepping motors corresponding to each result based on the rotation amount of the stepping motor which is necessary for each setting angle stored in the memory 18 beforehand and passes the result to the outputting unit 19.

In the outputting unit 19, based on the rotation amount of the up/down air direction control stepping motors passed from the area air direction controlling unit 22, the up/down air direction (left) control stepping motor 10*a* and the up/down air direction (right) control stepping motor 10*b* are rotated. As a result of this operation, the setting angles of the up/down air direction control board (left) 6*a* and the up/down air direction control board (right) 6*b* are set so as to rectify the airflow directed to the targeted area sections.

By the way, plural area sections developed two-dimensionally as shown in FIGS. 12 through 14 are classified to plural regions of the left region, the center region, and the right region, and the final setting angle of the up/down air direction control board (left) 6*a* and the up/down air direction control board (right) 6*b* are decided by the determining process shown in FIG. 14, because it is desired to carry out the operation such as operating directed to an area section by the up/down air direction control board 6 if one targeted area section exists, and blowing separately by each of the up/down air direction control boards 6 if two different locations are the targeted area sections.

Through the above discussed process, the setting angles are decided finally for all air direction control boards of the up/down air direction control board (left) 6*a*, the up/down air direction control board (right) 6*b*, the left/right air direction control board (left) 7*a*, and the left/right air direction control board (right) 7*b*. This air direction operation status is shown by a perspective view in FIG. 16. FIG. 17 omits the illustration of the left/right air direction control boards 7. FIG. 18 omits the illustration of the up/down air direction control boards 6.

As shown in the three figures, the setting angles of the up/down air direction control board (left) 6*a* and the up/down air direction control board (right) 6*b* are both set to stay in the middle between the horizontal blow and the downward blow. The setting angle of the left/right air direction control board (left) 7*a* and the left/right air direction control board (right) 7*b* are respectively set to direct outwardly from the center of the air-conditioner body 1. As a result of this, the airflow is blown from the air-conditioner body 1 to direct approximately downwardly and outwardly.

FIG. 19 illustrates this status in the indoor space. From FIG. 19, it is understood that the blowing airflow is rectified to direct to two targeted area sections of A2 and E2 where the human body is detected.

FIGS. 20 through 23 similarly show a result of the case in which the human body is detected in two area sections of E1 and E3. In this case, according to the specification of the number 2 of the up/down air direction control board (left)-(right) operation deciding table of FIG. 14, using the left/right direction one-dimensional data (right region) 25 directly, the up/down air direction control board (left) 6*a* and the up/down air direction control board (right) 6*b* both set to the same up/down air direction angle to rectify the blowing airflow from the air-conditioner body 1. However, by adding another step of the following simple determination process after the determination process using the up/down air direction control board (left)-(right) operation deciding table by the area air direction controlling unit 22, it is possible to control the airflow more precisely, which further improves the comfort.

The simple determination process is as follows: if all the targeted area sections exist in only one region and no target exists in the other region, the up/down air direction control board 6 of the same side of the region where the targeted area section exists is made operate to rectify the blowing airflow directed to the targeted area section of the side close to the air-conditioner body 1; and the up/down air direction control board 6 of the opposite side to the region where the targeted area section exists is made operate to rectify the blowing airflow directed to the targeted area section of the side far from the air-conditioner body 1.

If the human body location is detected in the two area sections of E1 and E3, the targeted area sections of E1 and E3 are all in the area sections existing in the right region side, and no targeted area section exists in the other regions, namely, the center region and the left region.

Further, the up/down air direction control board 6 of the same side of the region where the targeted area section exists is the up/down air direction control board (right) 6*b*, and thus the up/down air direction control board (right) 6*b* is controlled to rectify the blowing airflow directed to E1 which is the targeted area section of the side close to the air-conditioner body 1.

On the other side, the up/down air direction control board 6 of the opposite side to the region where the targeted area section exists is the up/down air direction control board (left) 6*a*, and thus the up/down air direction control board (left) 6*a* is controlled to rectify the blowing airflow directed to E3 which is the targeted area section of the side far from the air-conditioner body 1.

That is, the area air direction controlling unit 22 focuses its attention on only the left/right direction one-dimensional data (right region) 25, the left/right direction one-dimensional data (right region) 25 reads 1, 0, 1 from the $1^{st}$ row to the $3^{rd}$ row, so that temporary left/right direction one-dimensional data of 1, 0, 0 are assigned to the $1^{st}$ row to the $3^{rd}$ row of the up/down air direction control board (right) 6*b*, and temporary left/right direction one-dimensional data of 0, 0, 1 are assigned to the $1^{st}$ row to the $3^{rd}$ row of the up/down air direction control board (left) 6*a*. Then, by comparing the temporary left/right direction one-dimensional data with the up/down air direction setting table of FIG. 15, and each up/down air direction angle is determined.

According to the up/down air direction setting table of FIG. 15, data values of 1, 0, 0, from the $1^{st}$ row to the $3^{rd}$ row matches the case of number 5. In the number 5, the setting angle of the up/down air direction control board 6 is specified to be the up/down air direction No. 5, so that the up/down air direction control board (right) 6*b* is set to the up/down air direction No. 5.

Similarly, data values of 0, 0, 1, from the $1^{st}$ row to the $3^{rd}$ row matches the case of number 2. In the number 2, the setting angle of the up/down air direction control board 6 is specified to be the up/down air direction No. 1, so that the up/down air direction control board (left) 6*a* is set to the up/down air direction No. 1.

As a result of the above process, like arrows showing the blowing airflow from the air-conditioner body 1 illustrated in FIGS. 20 through 23, the right side half of the blowing airflow from the air-conditioner body 1 is rectified to direct to the area section E1 by the up/down air direction control board (right) 6*b* and the left/right air direction control board (right) 7*b*.

The left side half of the blowing airflow from the air-conditioner body 1 is rectified to direct to the area section E3 by the up/down air direction control board (left) 6*a* and the left/right air direction control board (left) 7*a*, and it is understood that the blowing airflow is rectified to blow separately to the two targeted area sections of E1 and E3 appropriately.

Further, in this case, each of the up/down air direction control boards 6 handles each of the area section by dividing the area sections in the depth direction; however, depending on circumstances, such as a case in winch the targeted area sections are located next to each other, the area sections can be divided in the left/right direction and assigned to each of the up/down air direction control boards 6.

Similarly, FIGS. 24 through 27 illustrate a result of a case in which the human body location is detected in two area sections of A1 and A3. In this case, since the targeted area sections exist only in the left region and no targeted area section exists in the other regions, the air direction angles are set to rectify the airflow so that the up/down air direction control board (left) 6*a* which is the same side of the left region is directed to the area section A1 and the up/down air direction control board (right) 6*b* which is the opposite side to the left region is directed to the area section A3. As a result, as shown as arrows showing the blowing airflow from the air-conditioner body 1 shown in FIGS. 24 through 27, the left side half of the blowing airflow from the air-conditioner body 1 is rectified to direct to the area section A1 by the up/down air direction control board (left) 6*a* and the left/right air direction control board (left) 7*a*. The right side half of the blowing airflow from the air-conditioner body 1 is rectified to direct to the area section A3 by the up/down air direction control board (right) 6*b* and the left/right air direction control board (right) 7*b*. Therefore, it is understood that the blowing airflow is rectified to blow separately to the targeted area sections of A1 and A3 appropriately.

Further, although not illustrated, even if plural targeted area sections exist and also they are arranged in a complicated status such that they are located far, the operation is to rectify the airflow to direct to the center of gravity of them, which can add appropriate redundancy, so that it is possible not to degrade comfort.

For example, if four area sections of A2, B1, D2, and E3 are the targeted area sections, the up/down air direction control board (left) 6*a* is set to the up/down air direction No. 4 according to the table of FIGS. 14 and 15, and similarly the up/down air direction control board (right) 6*b* is set to the up/down air direction No. 2. As for the left/right air direction control board (left) 7*a* and the left/right air direction control board (right) 7*b*, the left/right air direction control board (left) 7*a* is set to directed to the left-center, and the left/right air direction control board (right) 7*b* is directed to the right-center according to the table of FIG. 11, in general, the left half of the airflow blown from the air-conditioner body is rectified to direct to the center of gravity of the area sections of A2 and B1. Similarly, the right half of the blowing airflow is rectified to direct to the center of gravity of the area sections of D2 and E3. As a result, it is possible to blow the airflow to reach any targeted area section, so that comfort of the user existing each of the targeted area sections would not be degraded.

Here, in this embodiment, although each of the up/down air direction control board (left) 6*a* and the up/down air direction control board (right) 6*b* is formed of one board, it can be also formed of two boards, each arranged to at the up side and the down side of the outlet 4 and each dislocated in the depth direction. That is, the up/down air direction control boards 6 include four boards in total by two up/down air direction control boards (left) 6*a* and two up/down air direction control boards (right) 6*b*. Further, in order to operate four up/down air direction control boards independently, namely, for the up/down air direction control boards 6 formed of four boards as discussed, four up/down air direction control stepping motors 10 are provided, four up/down air direction control boards 6 are respectively coupled to the separate up/down air direction control stepping motors 10, and the four boards can be controlled independently, so that it is possible to carry out more precise air direction control directed to the targeted area section.

As discussed above, according to the first embodiment, for each area section of the group of area sections formed by developing plural area sections which is formed by dividing the indoor space where the air-conditioner is provided, the target area deciding unit 21 decides the area sections for air-conditioning by setting either of binary values: 0 if the area section is not a target for air-conditioning; and 1 if the area section is a target for air-conditioning. Therefore, the user of the air-conditioner does not need to set air direction with considering or assuming status of the blowing airflow of the air-conditioner, which improves the operability largely. In the first embodiment, an example of the input data to the target area deciding unit 21 is output result of the human body detecting sensor 14.

Further, the area air direction controlling unit 22 determines how to set each of the air direction control boards directed to the area section of the target for air-conditioning, so that without using vast air direction setting table which exhaustively defines the air direction setting according to generation patterns of the targeted area sections, it is possible to control the blowing airflow precisely even if the number of area sections is large such as fifteen, which brings effect to improve comfort.

Explaining more in detail, if the air direction setting table exhaustively defines the air direction setting according to generation patterns of the targeted area sections is generated and operated, it is necessary to generate the table defining the air direction setting for each of the air direction control boards for all generation patterns of the targeted area sections such as: each of air direction settings when A1 is the targeted area section; each of air direction settings when A2 is the targeted area section; each of air direction settings when A1 and A2 are the targeted area sections; each of air direction settings when A1, A2, and A3 are the targeted area sections. When the total number of area sections is 15 area sections, the number of all generation patterns of the targeted area sections is 32,768 patterns, and the air direction settings for 32,768 patterns has to be defined. By this first embodiment, the blowing airflow can be controlled precisely without using this vast air direction setting table.

Here, it is possible to prepare plural types of the left/right air direction setting table of FIG. 11, the up/down air direction setting table of FIG. 15, and the up/down air direction control boards (left)-(right) operation deciding table of FIG. 14 such as for cooling operation mode, heating operation mode, or air-directing mode for rectifying the airflow directed to the targeted area section, air-avoiding mode for rectifying the airflow so as to slightly avoid the targeted area section, etc. In this case, more precise air direction control can be done according to each of the operation modes, so that comfort is further improved. Since the airflow blown from the air-conditioner is directed to the targeted area section, the airflow does not blow directed to the area section for which air-conditioning is unnecessary, which brings effect of energy saving that it is possible not to consume unnecessary air-conditioning energy.

Further, since the operation is done without the vast air direction setting table which exhaustively defines the air direction setting according to generation patterns of the targeted area sections, it is possible to eliminate human mistake on setting the air direction even if the number of area sections is large, so that the quality of software of the air-conditioner can be improved and at the same time it is not necessary to consume vast developing load/evaluation time period for development of the air-conditioner. Therefore, the development of the air-conditioner can be performed efficiently, which brings effect to shorten the development time period.

Further, since the operation is done without the vast air direction setting table which exhaustively defines the air direction setting according to generation patterns of the targeted area sections, it is possible to reduce largely the capacity of microcomputer for storing the air direction setting table, which brings effect to reduce the cost of the microcomputer used.

Further, by dividing the air direction control boards to rectify the airflow blown from the air-conditioner body 1 for both of the up/down air direction control board 6 and the left/right air direction control board 7 into the up/down air direction control board (left) 6*a* and the left/right air direction control board (left) 7*a* for rectifying the left half of the blowing airflow, and the up/down air direction control board (right) 6*b* and the left/right air direction control board (right) 7*b* for rectifying the right half of the blowing airflow, it is possible to rectify the airflow independently in the left/right direction. Further, as shown in FIG. 12, by dividing the group of area sections into three regions in the left/right direction, it is possible to carry out appropriate air direction operation in any generation status of targeted area sections using the up/down air direction control boards (left)-(right) operation deciding table of FIG. 14. Therefore, even if the targeted air-conditioning area sections are in the arrangement status being located apart, it is possible to rectify the airflow appropriately with a high precision directed to each of the targeted area sections, which brings effect not to degrade comfort.

Further, on the other hand, even if the targeted area sections are in a complicated arranged status, the present embodiment includes appropriate redundancy to rectify the airflow directed to the center of gravity of them, which brings effect not to degrade comfort.

Further, by adding the above discussed simple determination process to the area air direction controlling unit 22 as has been explained in FIGS. 20 through 23, the present embodiment includes effect to have general versatility that it is possible to rectify the airflow more precisely and appropriately according to various arrangement status of the targeted area sections.

The air-conditioner of the invention is formed to rectify the blowing airflow of the air-conditioner to direct to a targeted air-conditioning area section when controlling the air direction of the air-conditioner, which brings effect to remove the troubles to set the air direction with considering of the blowing airflow of the air-conditioner by the user. Further, when the air direction of the air-conditioner is controlled to direct to a specific targeted area section for air-conditioning, without using an air direction table which decides beforehand how to direct the air direction for each of generation patterns of target area sections, the present invention is formed to accomplish the equivalent air direction control, which brings effect to avoid wasting variable capacity of the microcomputer.

Embodiment 2

In the foregoing first embodiment, the output result of the human body detecting sensor 14 is made the input data to the target area deciding unit 21. Next, the second embodiment will be explained, in which the user of the air-conditioner sets the air-conditioning area using a remote controller.

Figure 28:
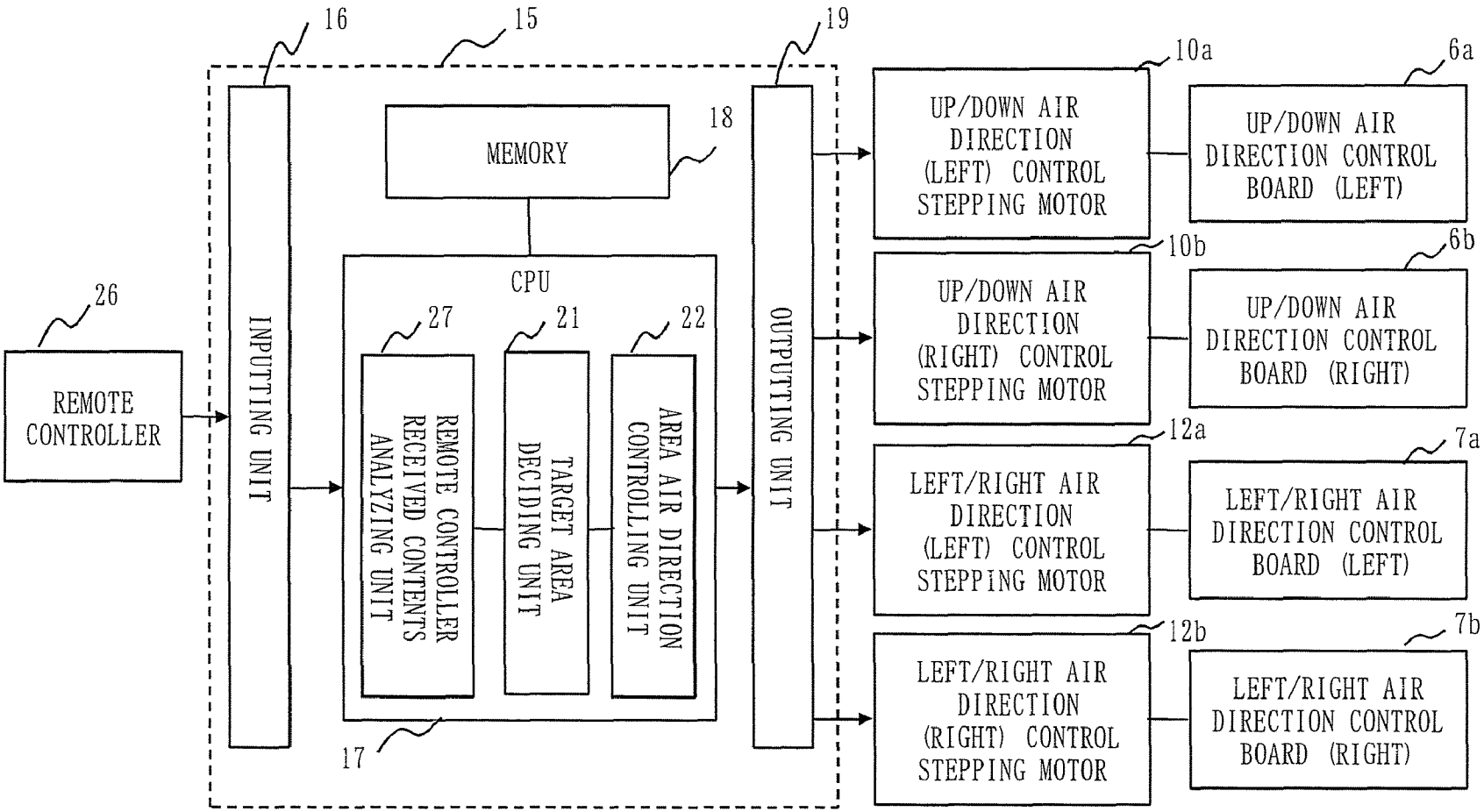
FIG. 28 shows the second embodiment and shows a microcomputer which forms a control device of the air-conditioner.
Figure 29:
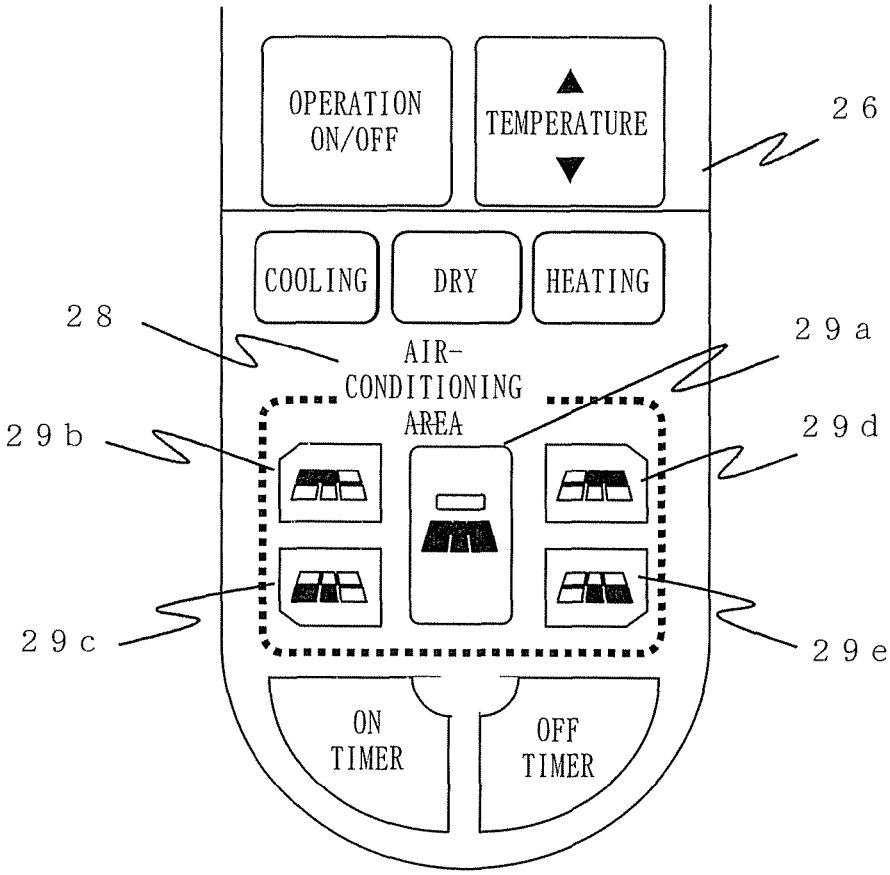
FIG. 29 shows the second embodiment and shows a remote controller of the air-conditioner.

FIGS. 28 and 29 show the second embodiment: FIG. 28 is a block diagram showing a microcomputer which forms a control device of the air-conditioner; and FIG. 29 shows a remote controller of the air-conditioner.

Here, the basic structure of the air-conditioner is the same as the first embodiment and its explanation is omitted. Further, the same sign is assigned to the same or equivalent part to the first embodiment and its explanation is omitted.

The human body detecting sensor 14 in FIG. 7 of the first embodiment is replaced with a remote controller 26, and further the human body detection determining unit 20 in FIG. 7 is replaced with a remote controller received contents analyzing unit 27 in FIG. 28. The other structural elements are the same as FIG. 7 of the first embodiment, and their operation contents and effect are the same.

As shown in FIG. 29, an operation setting unit of the remote controller 26 includes an area setting unit 28 to select an air-conditioning area desired by the user.

The area setting unit 28 is composed of five setting buttons including an area setting button (set all) 29*a* for setting the air-conditioning area as a whole, an area setting button (set left front) 29*b* for setting the air-conditioning area to the left-front region facing the air-conditioner, an area setting button (set left back) 29*c* for setting the air-conditioning area to the left-back region facing the air-conditioner, an area setting button (set right front) 29*d* for setting the air-conditioning area to the right-front region facing the air-conditioner, and an area setting button (set right back) 29*e* for setting the air-conditioning area to the right-back region facing the air-conditioner.

These are setting buttons having a function to set only each one of them and also to set respective buttons at the same time. One push of each button by the user causes setting, and another push releases the setting. Further, drawings as shown on the buttons of FIG. 29 are printed on each of the area setting buttons in order to allow the user to intuitively recall the air-conditioning area to be set. The drawings can be printed adjacent to the buttons instead of on the buttons.

Next, the operation of the air-conditioner according to the second embodiment will be explained.

When the user sets the desired air-conditioning area by operating the area setting unit 28 of the remote controller 26, a signal from the remote controller 26 is received at an inputting unit 16 of the control device 15 and transferred to a remote controller received contents analyzing unit 27 as shown in FIG. 28.

Signal transmission means from the remote controller 26 to the inputting unit 16 can be via wireless system such as infrared ray, and also wired transmission means can be used such as direct transmission by connecting the remote controller 26 and the air-conditioner body 1 with lead wire.

The remote controller received contents analyzing unit 27 analyzes the received remote controller signal, extracts a signal part related to setting of the air-conditioning area from the signal, and outputs the extracted contents to the target area deciding unit 21. The remote controller signal includes signals other than the one related to the setting of the air-conditioning area; however, it is obvious that the air-conditioner operates, for example, based on the setting contents such as setting air volume, and it is not directly related to the present invention, so that its explanation is omitted here.

Then the target area deciding unit 21 outputs the determined result of the targeted area sections by setting data so as to set 1 to the targeted area section and 0 to the area section which is not targeted for each area section of the group of area sections formed of 15 area sections based on the inputted air conditioning area setting information as has been explained in the first embodiment.

This is, the human body detected area section information determined by the human body detection determining unit 20 and outputted to the target area deciding unit 21 in the first embodiment is replaced with information of the air-conditioning area setting status infonnation analyzed/outputted by the remote controller received contents analyzing unit 27 in the second embodiment. Accordingly, the operation contents after the operation of the target area deciding unit 21 are totally the same as the first embodiment.

As discussed above, since the second embodiment allows the user of the air-conditioner to set by himself/herself the desired air-conditioning region, the embodiment includes effect to remove troubles that the user has to set each air direction with considering or recalling of the status of blowing airflow from the air-conditioner without using an expensive component such as the human body detecting sensor, the user can set the desired air-conditioning area, and it is possible to surely achieve the appropriate blowing airflow according to the setting.

Embodiment 3

The foregoing first and second embodiments are for the air-conditioner structured to have the up/down air direction control board 6 and the left/right air direction control board 7 dividing into the left side and the right side so as to independently rectify the left half and the right half of the airflow blown from the air-conditioner body 1. Next, another air-conditioner of which the up/down air direction control board 6 and the left/right air direction control board 7 are not divided into the left side and the right side will be explained as the third embodiment.

Figure 30:
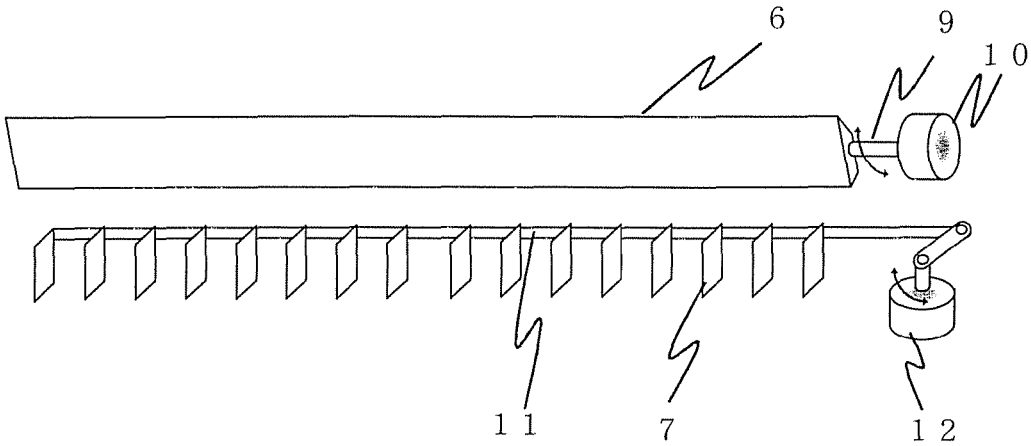
FIG. 30 shows the third embodiment and is a structural drawing of an air direction control driving unit showing a structure of a driving unit related to air direction control.
Figure 31:
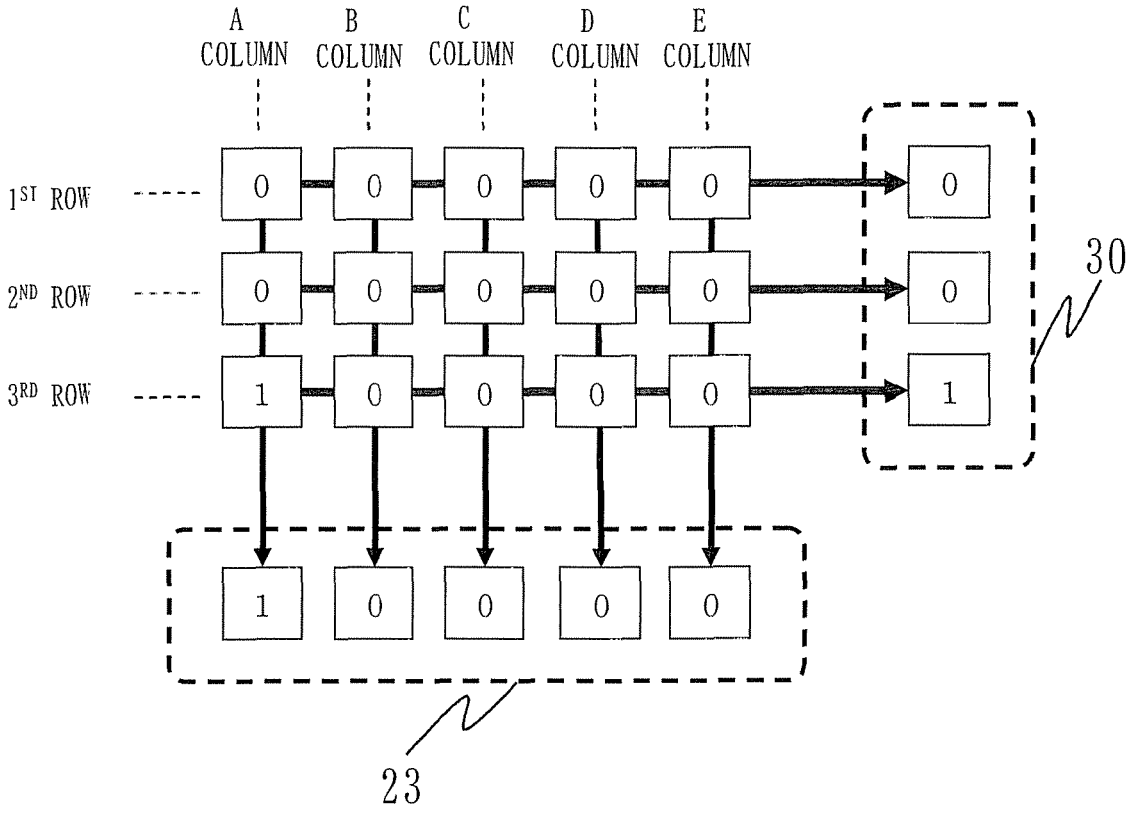
FIG. 31 shows the third embodiment and shows generation status of depth direction one-dimensional data to decide a setting value for driving the left/right air direction control stepping motor and left/right direction one-dimensional data to decide a setting value for driving the up/down air direction control stepping motor when the human body is detected in the area section A3.
Figure 33:
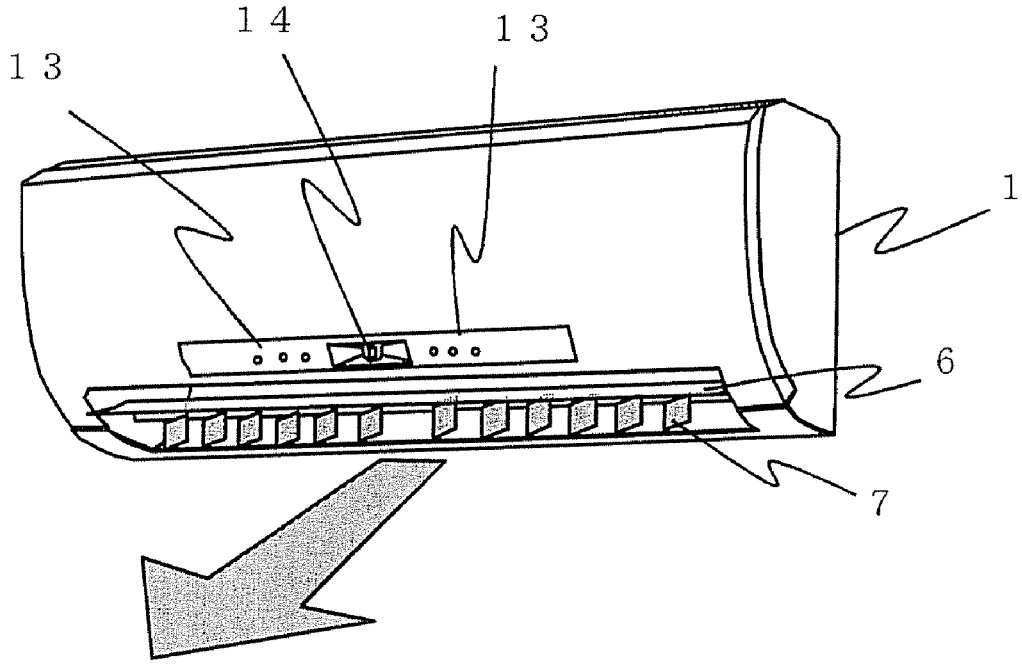
FIG. 33 shows the third embodiment and is a perspective view showing air direction operation of the air-conditioner when the human body is detected in the area section A3.
Figure 34:
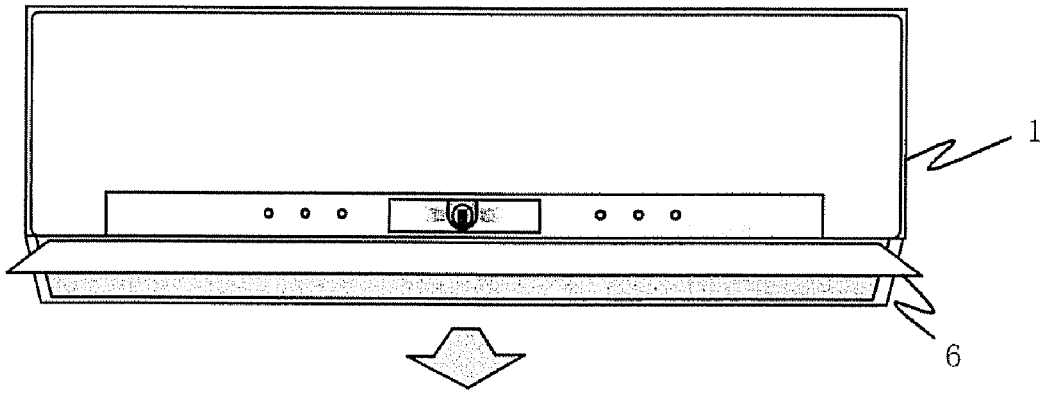
FIG. 34 shows the third embodiment and is a front view of the air-conditioner, omitting illustration of the left/right air direction control board when the human body is detected in the area section A3.
Figure 35:
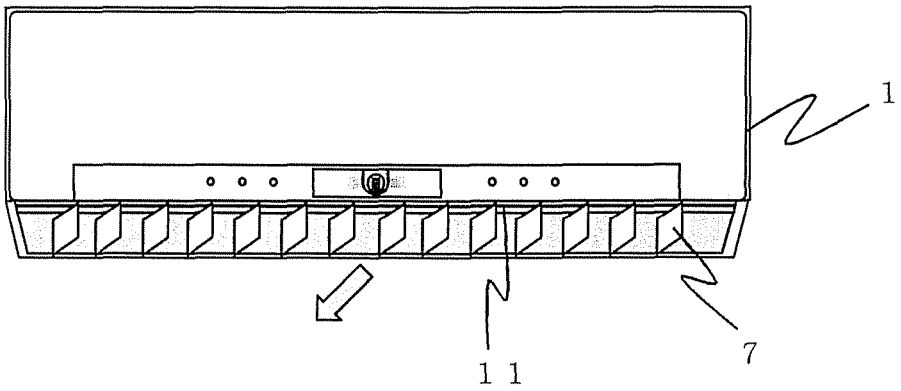
FIG. 35 shows the third embodiment and is a front view of the air-conditioner, omitting illustration of the up/down air direction control board when the human body is detected in the area section A3.
Figure 36:
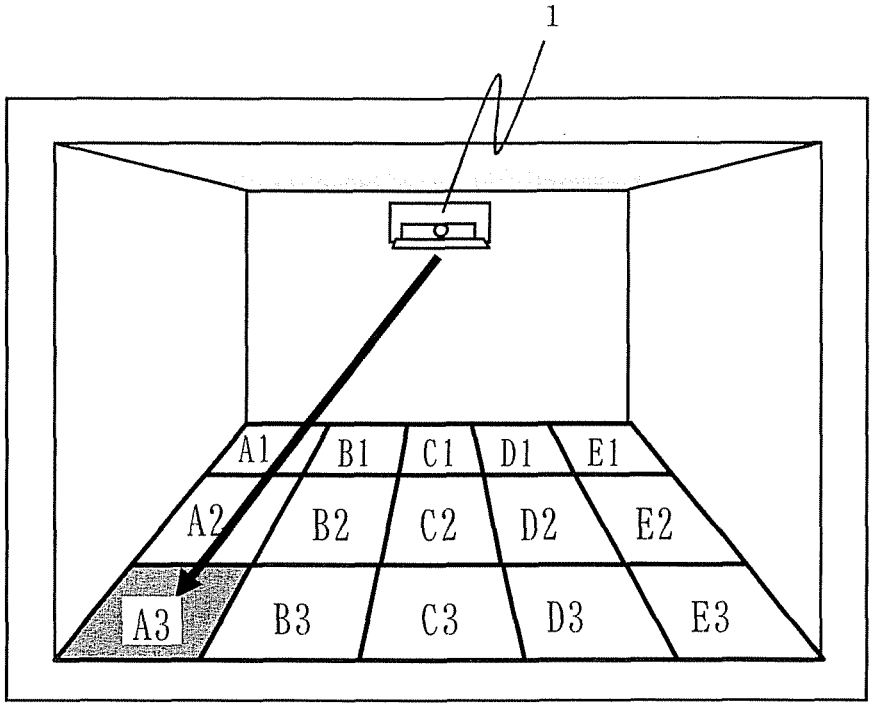
FIG. 36 shows the third embodiment and shows the room, in which the air-conditioner body is provided at an upper part of the wall, and shows the air direction operation status of the air-conditioner when the human body is detected in the area section A3.
Figure 37:
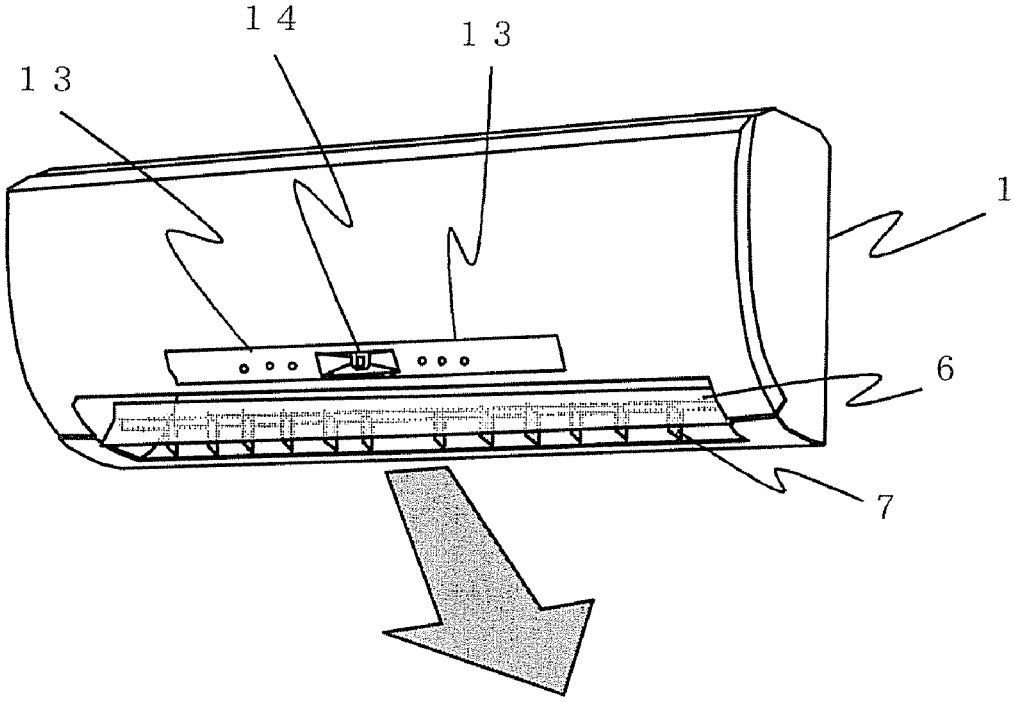
FIG. 37 shows the third embodiment and is a perspective view of the air-conditioner when the human body is detected in the area section E1.
Figure 38:
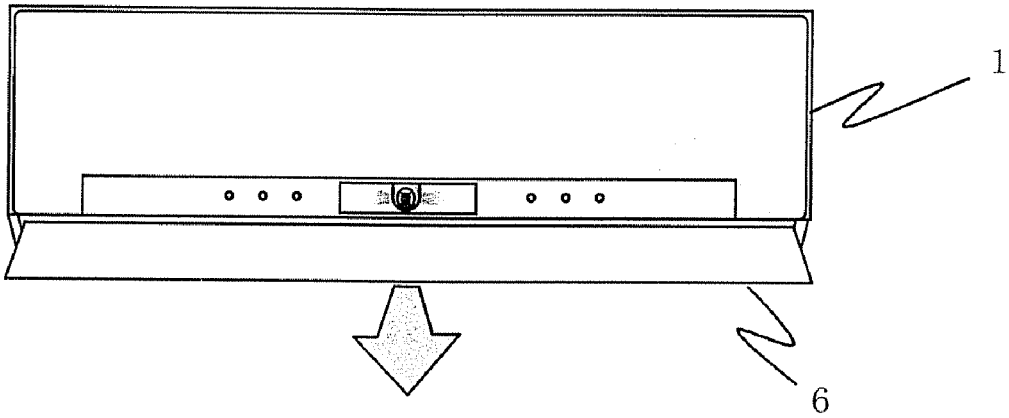
FIG. 38 shows the third embodiment and is a front view of the air-conditioner, omitting illustration of the left/right air direction control board when the human body is detected in the area section E1.
Figure 39:
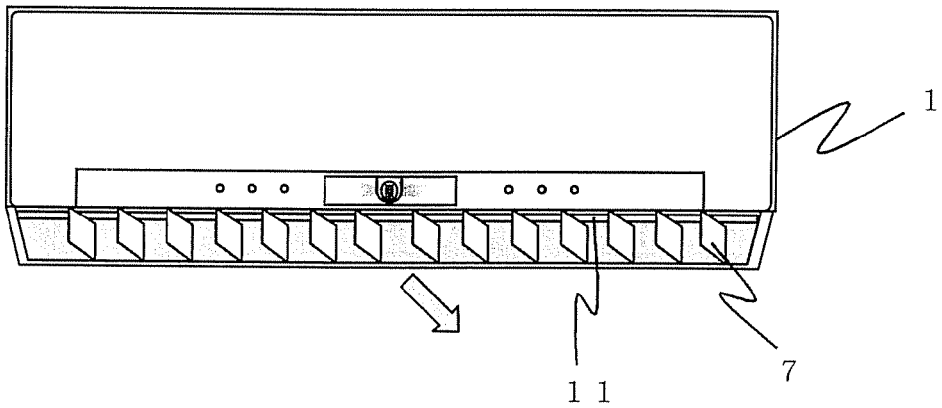
FIG. 39 shows the third embodiment and is a front view of the air-conditioner, omitting illustration of the up/down air direction control board when the human body is detected in the area section E1.
Figure 40:
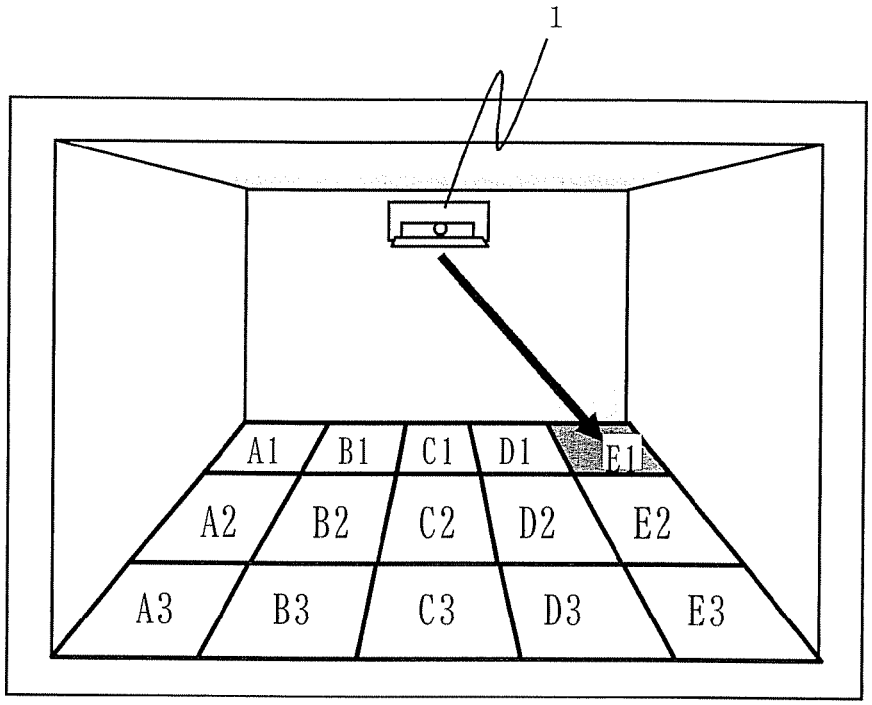
FIG. 40 shows the third embodiment and shows the room, in which the air-conditioner body is provided at an upper part of the wall, and shows the air direction operation status of the air-conditioner when the human body is detected in the area section E1.

FIGS. 30 through 40 show the third embodiment: FIG. 30 is a structural drawing of air direction control driving unit showing a structure of a driving unit related to air direction control; FIG. 31 shows generation status of depth direction one-dimensional data to decide a setting value for driving the left/right air direction control stepping motor and left/right direction one-dimensional data to decide a setting value for driving the up/down air direction control stepping motor when the human body is detected in the area section A3; FIG. 32 shows a left/right air direction setting table to decide the operation of the left/right air direction control board of the air-conditioner; FIG. 33 is a perspective view showing air direction operation of the air-conditioner when the human body is detected in the area section A3; FIG. 34 is a front view of the air-conditioner, omitting illustration of the left/right air direction control board when the human body is detected in the area section A3; FIG. 35 is a front view of the air-conditioner, omitting illustration of the up/down air direction control board when the human body is detected in the area section A3; FIG. 36 shows a room in which the air-conditioner body of the air-conditioner is provided at an upper part of the wall, and shows the air direction operation status of the air-conditioner when the human body is detected in the area section A3; FIG. 37 is a perspective view showing the air direction operation of the air-conditioner when the human body is detected in the area section E1; FIG. 38 is a front view of the air-conditioner, omitting illustration of the left/right air direction control board when the human body is detected in the area section E1; FIG. 39 is a front view of the air-conditioner, omitting illustration of the up/down air direction control board when the human body is detected in the area section E1; and FIG. 40 shows the room, in which the air-conditioner body of the air-conditioner is provided at an upper part of the wall, and shows the air direction operation status of the air-conditioner when the human body is detected in the area section E1.

As shown in FIG. 30, the up/down air direction control board 6 is not divided in the left/right direction but formed of one board. The up/down air direction control board 6 is coupled to the up/down air direction control stepping motor 10 with the up/down air direction control board (right) link rod 9. By rotation of the up/down air direction control stepping motor 10, the angle of the up/down air direction control board 6 is changed, and by this operation, it is possible to adjust the up/down air direction angle of the airflow blown from the air-conditioner body 1.

Further, the left/right air direction control board 7 is formed of plural pieces of air direction control boards, and the plural pieces of air direction control boards are coupled with the left/right air direction control board link rod 1. The left/right air direction control board link rod 11 is not divided in the left/right direction but is formed of one link rod, so that all of the left/right air direction control boards 7 carry out the same operation. To the end of the left/right air direction control board link rod 11, the left/right air direction control stepping motor 12 is coupled, by rotation of the left/right air direction control stepping motor 12, the angle of the left/right air direction control board 7 is changed, and by this operation, it is possible to adjust the left/right air direction angle of the airflow blown from the air-conditioner body 1. Here, except for this, the basic structure of the air-conditioner of the third embodiment is the same as the first embodiment, and the explanation is omitted. Further, the same sign is assigned to the same or equivalent part to the first embodiment, and its explanation is omitted.

Further, as for a circuit configuration of the microcomputer embedded in the control device 15 mounted inside of the air-conditioner body 1 of the air-conditioner according to the third embodiment, in the first embodiment as shown in FIG. 7, two sets of the up/down air direction control stepping motors for the up/down air direction control boards and for changing their air direction angles are mounted separately for rectifying the left half airflow and for rectifying the right half airflow; however, the third embodiment is structured by one set without separating. Similarly, in the first embodiment, two sets of the left/right air direction control stepping motors for the left/right air direction control board and for changing their air direction angles are mounted separately for rectifying the left half airflow and for rectifying the right half airflow; however, the third embodiment is structured by one set without separating. The other structure is the same as the first embodiment.

The operation of the air-conditioner structured as above according to the third embodiment will be explained.

If, for example, the area section of A3 (the A column, the $3^{rd}$ row) is the targeted area section, the target area deciding unit 21 sets "1" to the area section of A3 and "0" to the other area sections as shown in FIG. 31, and outputs a result of existence status of the target area to the area air direction controlling unit 22.

On inputting the data, the area air direction controlling unit 22 calculates left/right direction one-dimensional data 30 for deciding an air direction angle of the up/down air direction control board 6 and depth direction one-dimensional data 23 for deciding an air direction angle of the left/right air direction control board 7.

At this time, the depth direction one-dimensional data 23 is calculated in the same maimer as the air-conditioner of the first embodiment as shown in FIG. 31, and the calculated result becomes as shown in the broken-lined block in the lower part of FIG. 31.

As for the left/right direction one-dimensional data 30 for deciding the air direction angle of the up/down air direction control board 6, in the third embodiment, since the up/down air direction control board 6 is not divided into left and right but formed of one piece, without necessity of considering the air direction operation by dividing the group of area sections into plural regions of the left region, the center region, and the right region such as done in the air-conditioner of the first embodiment, it is enough to calculate only one left/right direction one-dimensional data 30 in total. Although the area sections are not divided into plural regions, the calculation method for calculating the logical sum of the area sections for each row is the same as the first embodiment. Therefore, the left/right direction one-dimensional data 30 in case of the third embodiment is the calculated result shown in the broken-lined block in the right side of FIG. 31.

Next, the method to decide the setting angle of the left/right air direction control board 7 will be explained.

The area air direction controlling unit 22 extracts data which matches the depth direction one-dimensional data 23 used by the left/right air direction control board 7 from the left/right air direction setting table stored in the memory 18 and decides the final setting angle of the left/right air direction control board 7.

Although the left/right air direction setting table of FIG. 11 is used in the air-conditioner of the first embodiment, the left/right air direction setting table of FIG. 32 is used in the air-conditioner of the third embodiment, since the left/right air direction control board 7 is not divided into left and right.

If the area section of A3 (the A column, the 3rd row) is the targeted area section, the depth direction one-dimensional data 23 reads a result of 1, 0, 0, 0, 0 from the A column to the E column as shown in FIG. 31, which matches the contents written in the row of the case of number 17 in the left/right air direction setting table of FIG. 32.

In the number 17, the setting angle of the left/right air direction control board 7 is directed to the left, the area air direction controlling unit 22 decides the rotation amount of the stepping motor necessary for the setting angle stored in the memory 18 beforehand and passes this result to the outputting unit 19.

In the outputting unit 19, the left/right air direction control stepping motor 12 is rotated based on the rotation amount of the stepping motor, and as a result of this operation, the setting angle of the left/right air direction control board 7 is set for rectifying the airflow directed to the targeted area section.

By the way, in FIG. 32, if the targeted area section exists on only one row, it is set to directly blow to that row, however, if the targeted area sections exist on plural rows at the same time, it is impossible to blow separately since the left/right air direction control board is not divided into left and right in the air-conditioner according to the third embodiment. Because of this, in such a case, it is set to swing in the left/right direction so as to blow alternately between respective columns.

Next, the method to decide the setting angle of the up/down air direction control board 6 will be explained.

The area air direction controlling unit 22 extracts data which matches the left/right direction one-dimensional data 30 used by the up/down air direction control board 6 from the up/down air direction setting table stored in the memory 18 and decides the final setting angle of the up/down air direction control board 6.

Here, the up/down air direction setting table of FIG. 15 can be applied in the third embodiment as well as the first embodiment, and also the up/down air direction setting table including swing operation can be used as explained in the operation of the left/right air direction control board 7. Here, FIG. 15 is used as well as the first embodiment.

Further, since the up/down air direction control board 6 is formed of plural boards in the first embodiment, after applying the up/down air direction control boards (left)-(right) operation deciding table of FIG. 14, the final setting angle of the up/down air direction control board 6 is decided based on the up/down air direction setting table of FIG. 15. On the contrary, in the air-conditioner of the third embodiment, the up/down air direction control board 6 is not divided into left and right but formed of one board, so that the setting angle is decided directly from the up/down air direction setting table of FIG. 15 without using the up/down air direction control boards (left)-(right) operation deciding table of FIG. 14.

If the area section of A3 (the A column, the 3rd row) is the targeted area section, the left/right one-dimensional data 30 reads data values of 0, 0, 1 from the $1^{st}$ row to the $3^{rd}$ row, which matches the contents written in the row of the number 2 in the up/down air direction setting table of FIG. 15. In the number 2, the setting angle of the up/down air direction control board 6 is the up/down air direction No. 1, so that the area air direction controlling unit 22 decides rotation amount of the stepping motor necessary for the setting angle stored in the memory 18 beforehand and passes this result to the outputting unit 19.

In the outputting unit 19, the up/down air direction control stepping motor 10 is rotated based on the rotation amount of the stepping motor, and as a result of this operation, the setting angle of the up/down air direction control board 6 is set for rectifying the airflow directed to the targeted area section.

Through the above process, finally the setting angles of all air direction control boards of the up/down air direction control board 6 and the left/right air direction control board 7 are set. FIG. 33 is a perspective view showing this air direction operation status. FIG. 34 omits illustration of the left/right air direction control board 7. FIG. 35 omits illustration of the up/down air direction control board 6.

As shown in these three figures, the angle of the up/down air direction control board 6 is set in the horizontally blowing direction. The angle of the left/right air direction control board 7 is set in the left direction. As a result, the airflow blown from the air-conditioner body 1 is blown horizontally and also directed to the left direction as shown by an arrow.

FIG. 36 illustrates the indoor space showing the above status, and it is understood that the blowing airflow is rectified appropriately so as to direct to the targeted area section of A3 which is located in the left far direction from the air-conditioner body 1.

FIGS. 37 through 40 similarly illustrate a result of a case in which the targeted area section is the area section of E1. In this case, since the setting angle of the up/down air direction control board 6 is set downward and the setting angle of the left/right air direction control board 7 is directed to the right based on the determined result of the area air direction controlling unit 22, the airflow is blown downwardly and in the right direction as shown in the figure, and it is understood that the blowing airflow is rectified so as to direct to the targeted area section of E1 which is a target and located near in the right to the air-conditioner body 1.

As discussed above, according to the third embodiment, the up/down air direction control board 6 and the left/right air direction control board 7 are not divided into left and right but formed of one set each, so that in addition to the effect of the first embodiment, it is possible to simplify the structure, which brings effect to reduce manufacturing cost.

Here, in the air-conditioner shown in the foregoing first through third embodiments, the air outlets 4 are located in the left/right direction; however, if the air-conditioner body 1 is formed vertically so that the longitudinal direction is up/down direction and the air outlets 4 are located vertically, the air direction control of the invention can be applied and the same effect can be obtained.

Further, the foregoing first through third embodiments relate to the air direction control of the air-conditioner; however, setting a predetermined space as a target area, blowing air to the space, and controlling its air direction is not limited to the operation of the air-conditioner. It is needless to say that the present invention can be effectively applied to other devices having air-blowing mechanism which blow air, for example, a heating exclusive device such as a fan heater, etc., an air purifier, a dryer, a humidifier, etc.

Further, although it has been discussed for air direction control, the present invention does not limit a target for control only to the air direction, but the present invention can be applied to a case in which an equipment or a device controls an actuator (a control actuator) such as a control driving motor, etc. to direct to a specific area section out of plural area sections. Here, the actuator means a mechanic element to convert to final mechanical work in an equipment or a device; in the air direction control of the air-conditioner shown in the first through third embodiments, the up/down air direction control stepping motor 10 (the up/down air direction (left) control stepping motor 10*a*, the up/down air direction (right) control stepping motor 10*b*) and the left/right air direction control stepping motor 12 (the left/right air direction (left) control stepping motor 12*a*, the left/right air direction (right) control stepping motor 12*b*) are actuators (control actuator).

A working target space of an equipment or a device including plural control actuators is divided into plural area sections, and the area sections are developed two-dimensionally to generate a group of area sections. If a group of area sections is set in the equipment or the device beforehand, the prescribed group of area sections can be also used. Either of binary values of 0 and 1 is set to each two-dimensional area section of the group of area sections, and the area section which is a target for working is decided. Then, when controlling the plural control actuators to direct to the targeted area section, these control actuators are separated to an X-axis system control actuator working for the X-axis direction of the group of area sections and a Y-axis system control actuator working for the Y-axis direction of the group of area sections. The X-axis system control actuator carries out control operation based on Y-axis direction one-dimensional data obtained from calculation for each column of a logical sum of each area section in the Y-axis direction in the group of area sections, and Y-axis system control actuator carries out control operation based on X-axis direction one-dimensional data obtained from calculation for each column of a logical sum of each area section in the X-axis direction in the group of area sections.

As an application example to other than the air direction control, the invention can be applied to, for example, illumination direction control by a lighting device. Stage to be illuminated is grasped two-dimensionally from the ceiling, the stage is divided into plural area sections, and illumination is done directed to one or plural arbitrarily specified area sections among the plural area sections. At this time, by applying the invention to operating the limited number of lighting devices by a control actuator such as a driving motor, etc., it is possible to obtain the same effect as the air direction control of the air-conditioner shown in the first through third embodiments.

Further, the embodiment is applicable to a control actuator which drives limited transportation devices such as a robot, a conveyor, etc. when the transportation device transporting cargo into a cargo storage transports cargo to a specific area section of the cargo storage and unloads the cargo.

Here, in the first through third embodiments, the control operation is carried out by the left/right air direction control stepping motor 12 (the left/right air direction (left) control stepping motor 12*a*, the left/right air direction (right) control stepping motor 12*b*) which corresponds to the X-axis system control actuator, and the up/down air direction control stepping motor 10 (the up/down air direction (left) control stepping motor 10*a*, the up/down air direction (right) control stepping motor 10*b*) which corresponds to the Y-axis system control actuator. The left/right direction is the X-axis, and the depth direction is the Y-axis.

Further, in case of applying to other than the air direction control, if plural Y-axis system control actuators are provided, another control method, in which the group of area sections developed two-dimensionally is divided into at least two regions, and the X-axis direction one-dimensional data of each region is made corresponding to each of the plural Y-axis system control actuator, can be applied similarly and the same effect can be obtained.

Further, on the contrary to the above, if plural X-axis system control actuators are provided, the group of area sections developed two-dimensionally is divided into at least two regions, and the control operation is done by making the Y-axis direction one-dimensional data of each region corresponding to each of the plural Y-axis system control actuator.

Having thus described several particular embodiments of the present invention, various alterations, modifications, and improvements will readily occur to those skilled in the art. Such alterations, modifications, and improvements are intended to be part of this disclosure, and are intended to be within the spirit and scope of the present invention. Accordingly, the foregoing description is by way of example only, and is not intended to be limiting. The present invention is limited only as defined in the following claims and the equivalents thereto.

The invention claimed is:

1. An air-conditioner comprising:

an air-conditioner body;

an up/down air direction control board provided at an air outlet blowing out air of the air-conditioner body for rectifying blowing airflow in up/down direction;

an up/down air direction control stepping motor for adjusting an angle of the up/down air direction control board;

a left/right air direction control board provided at the air outlet blowing out air of the air-conditioner body for rectifying blowing airflow in a left/right direction;

a left/right air direction control stepping motor for adjusting an angle of the left/right air direction control board; and a control device controlling at least the up/down air direction control stepping motor and the left/right air direction control stepping motor, wherein the control device includes:

a target area deciding unit for setting either of binary values of 0 and 1 to each area section of a group of area sections which is obtained by developing two-dimensionally a plurality of area sections that are obtained by dividing an indoor space at which the air-conditioner is provided, and deciding a targeted area section for air-conditioning among the group of area sections; and an area air direction control unit for carrying out control operation, so that when controlling at least one of the up/down air direction control stepping motor and the left/right air direction control stepping motor directed to the targeted area section for air-conditioning, the left/right air direction control stepping motor carries out control operation based on depth direction one-dimensional data obtained by calculating a logical sum of each column in depth direction of each area section in the group of area sections, and the up/down air direction control stepping motor carries out control operation based on left/right direction one-dimensional data obtained by calculating a logical sum of each column in left/right direction of each area section in the group of area sections.

2. The air-conditioner of claim 1 comprising a plurality of the up/down air direction control boards and a plurality of the up/down air direction control stepping motors, wherein the control unit classifies the group of area sections which is two-dimensionally developed from the left/right direction one-dimensional data, and includes the area air direction control unit in which the left/right direction one-dimensional data of each region is made corresponding to each of the up/down air direction control stepping motors.

3. An air direction control method of an air-conditioner having: an air-conditioner body, an up/down air direction control board provided at an air outlet blowing out air of the air-conditioner body for rectifying blowing airflow in up/down direction; an up/down air direction control stepping motor for adjusting an angle of the up/down air direction control board; a left/right air direction control board provided at the air outlet blowing out air of the air-conditioner body for rectifying blowing airflow in a left/right direction; and a left/right air direction control stepping motor for adjusting an angle of the left/right air direction control board, the method comprising:

setting either of binary values of 0 and 1 to each area section of a group of area sections which is obtained by developing two-dimensionally a plurality of area sections that are obtained by dividing an indoor space at which the air-conditioner is provided, and deciding a targeted area section for air-conditioning among the group of area sections;

when controlling at least one of the up/down air direction control stepping motor and the left/right air direction control stepping motor directed to the targeted area section for air-conditioning, by the left/right air direction control stepping motor, carrying out control operation based on depth direction one-dimensional data obtained by calculating a logical sum of each column in depth direction of each area section in the group of area sections, and by the up/down air direction control stepping motor, carrying out control operation based on left/right direction one-dimensional data obtained by calculating a logical sum of each column in left/right direction of each area section in the group of area sections.

4. A control method for an actuator controlling a plurality of control actuators, the method comprising:

setting either of binary values of 0 and 1 to each area section of a group of area sections which is obtained by developing two-dimensionally a plurality of area sections, and deciding a targeted area section;

when controlling the plurality of control actuators directed to the targeted area section, separating the control actuators to an X-axis system control actuator relating to an X-axis direction of the group of area sections and a Y-axis system control actuator relating to a Y-axis direction of the group of area sections;

by the X-axis system control actuator, carrying out control operation based on Y-axis direction one-dimensional data obtained by calculating a logical sum of each column in the Y-axis direction of each area section in the group of area sections; and by the Y-axis system control actuator, carrying out control operation based on X-axis direction one-dimensional data obtained by calculating a logical sum of each column in the X-axis direction of each area section in the group of area sections.

* * * * *